US008308254B2

(12) United States Patent
Tabata et al.

(10) Patent No.: US 8,308,254 B2
(45) Date of Patent: Nov. 13, 2012

(54) LIQUID JET APPARATUS

(75) Inventors: Kunio Tabata, Shiojiri (JP); Atsushi Oshima, Shiojiri (JP); Noritaka Ide, Shiojiri (JP); Shinichi Miyazaki, Suwa (JP); Hiroyuki Aizawa, Shiojiri (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 12/389,525

(22) Filed: Feb. 20, 2009

(65) Prior Publication Data

US 2009/0213152 A1 Aug. 27, 2009

(30) Foreign Application Priority Data

Feb. 21, 2008 (JP) ..... 2008-039881

(51) Int. Cl.
*B41J 29/38* (2006.01)

(52) U.S. Cl. ..... 347/9; 347/10; 347/11

(58) Field of Classification Search ..... 347/9–12; 330/10

See application file for complete search history.

(56) References Cited

U.S. PATENT DOCUMENTS

| | | | |
|---|---|---|---|
| 2,915,589 | A | 12/1959 | Plant |
| 4,254,439 | A | 3/1981 | Fowler et al. |
| 4,992,749 | A | 2/1991 | Tokumo et al. |
| 5,262,733 | A | 11/1993 | Nakajima et al. |
| 5,283,658 | A | 2/1994 | Hayashi et al. |
| 5,406,314 | A | 4/1995 | Kuehnle |
| 5,475,405 | A | 12/1995 | Widder et al. |
| 5,675,296 | A | 10/1997 | Tomikawa |
| 5,894,314 | A | 4/1999 | Tajika et al. |
| 6,133,844 | A | 10/2000 | Ahne et al. |
| 6,267,519 | B1 | 7/2001 | Otsuki et al. |
| 6,312,076 | B1 | 11/2001 | Taki et al. |
| 6,312,096 | B1 | 11/2001 | Koitabashi et al. |
| 6,320,605 | B1 | 11/2001 | Ikeda et al. |
| 6,344,811 | B1 | 2/2002 | Melanson |
| 6,364,443 | B1 | 4/2002 | Katano et al. |
| 6,431,676 | B2 | 8/2002 | Asauchi et al. |
| 6,443,547 | B1 | 9/2002 | Takahashi et al. |
| 6,454,377 | B1 | 9/2002 | Ishizaki |

(Continued)

FOREIGN PATENT DOCUMENTS

EP 1594224 11/2005

(Continued)

OTHER PUBLICATIONS

U.S. Appl. No. 11/780,379, Aug. 20, 2010, Final Office Action.

(Continued)

*Primary Examiner* — Jason Uhlenhake
(74) *Attorney, Agent, or Firm* — Maschoff Gilmore & Israelsen

(57) ABSTRACT

A liquid jet apparatus according to the invention is a liquid jet apparatus adapted to emit a jet of a liquid by driving an actuator of a liquid jet head with a drive signal including a digital power amplifier and a low pass filter provided to the liquid jet head so as to correspond to the actuator, and adapted to power-amplify and smooth a modified signal from a control circuit to form the drive signal, wherein the low pass filter is coupled directly with the actuator, and the digital power amplifier is provided with a pair of switching elements and a gate drive circuit, and ON-OFF controls the gate drive circuit based on print data, thereby performing one of output and halt of the drive signal.

5 Claims, 14 Drawing Sheets

U.S. PATENT DOCUMENTS

| | | | | |
|---|---|---|---|---|
| 6,457,794 | B1 | 10/2002 | Tajika et al. | |
| 6,474,762 | B2 | 11/2002 | Taki et al. | |
| 6,652,055 | B2 | 11/2003 | Oikawa | |
| 6,739,686 | B2 | 5/2004 | Imai | |
| 6,776,469 | B2 | 8/2004 | Nozawa | |
| 6,929,340 | B2 | 8/2005 | Ishizaki | |
| 7,038,534 | B2 | 5/2006 | Hanzlik | |
| 7,083,274 | B2 | 8/2006 | Morita | |
| 7,111,755 | B2 | 9/2006 | Koyama et al. | |
| 7,170,544 | B2 | 1/2007 | Horiuchi | |
| 7,244,007 | B2 | 7/2007 | Ishizaki | |
| 7,252,355 | B2 | 8/2007 | Umeda | |
| 7,357,496 | B2 | 4/2008 | Silverbrook et al. | |
| 7,384,128 | B2 | 6/2008 | Sheahan et al. | |
| 7,416,268 | B2 | 8/2008 | Oku | |
| 7,571,989 | B2 | 8/2009 | Ishizaki | |
| 7,581,802 | B2 | 9/2009 | Tabata et al. | |
| 7,585,037 | B2 | 9/2009 | Tabata et al. | |
| 7,717,530 | B2 | 5/2010 | Oshima | |
| 7,731,317 | B2 | 6/2010 | Oshima | |
| 2001/0040595 | A1 | 11/2001 | Taki et al. | |
| 2002/0113832 | A1 | 8/2002 | Kanematsu et al. | |
| 2002/0142733 | A1 | 10/2002 | Nishinakagawa | |
| 2002/0163458 | A1 | 11/2002 | Jin | |
| 2003/0112297 | A1 | 6/2003 | Hiratsuka et al. | |
| 2003/0231179 | A1 | 12/2003 | Suzuki | |
| 2004/0047477 | A1 | 3/2004 | Bank et al. | |
| 2004/0119770 | A1* | 6/2004 | Tamura | 347/19 |
| 2004/0233241 | A1 | 11/2004 | Salacz | |
| 2005/0116977 | A1 | 6/2005 | Shinkawa et al. | |
| 2005/0231179 | A1 | 10/2005 | Ishizaki | |
| 2005/0248399 | A1 | 11/2005 | Kurokawa | |
| 2006/0132231 | A1 | 6/2006 | Ishii et al. | |
| 2006/0181342 | A1 | 8/2006 | Kanoh | |
| 2007/0079710 | A1 | 4/2007 | Ishizaki | |
| 2007/0120938 | A1 | 5/2007 | Fitzpatrick et al. | |
| 2007/0165074 | A1 | 7/2007 | Ishizaki | |
| 2008/0018683 | A1* | 1/2008 | Oshima et al. | 347/10 |
| 2008/0018686 | A1 | 1/2008 | Oshima et al. | |
| 2008/0100652 | A1 | 5/2008 | Oshima et al. | |
| 2008/0186350 | A1 | 8/2008 | Oshima et al. | |
| 2008/0198191 | A1 | 8/2008 | Oshima | |
| 2008/0218545 | A1 | 9/2008 | Oshima et al. | |
| 2009/0033698 | A1 | 2/2009 | Suzuki et al. | |
| 2009/0066739 | A1 | 3/2009 | Tabata et al. | |
| 2009/0140780 | A1 | 6/2009 | Miyazaki et al. | |
| 2009/0174738 | A1 | 7/2009 | Oshima | |
| 2009/0267979 | A1 | 10/2009 | Tabata et al. | |
| 2009/0289980 | A1 | 11/2009 | Tabata et al. | |
| 2009/0303271 | A1 | 12/2009 | Tabata et al. | |
| 2010/0091059 | A1 | 4/2010 | Oshima et al. | |
| 2010/0097419 | A1 | 4/2010 | Oshima | |
| 2010/0118078 | A1 | 5/2010 | Oshima et al. | |
| 2010/0188452 | A1 | 7/2010 | Oshima | |
| 2010/0220133 | A1 | 9/2010 | Oshima et al. | |
| 2011/0102486 | A1 | 5/2011 | Tabata et al. | |
| 2011/0109674 | A1 | 5/2011 | Oshima et al. | |

FOREIGN PATENT DOCUMENTS

| | | | |
|---|---|---|---|
| JP | 63-247059 | | 10/1988 |
| JP | 02-262705 | | 10/1990 |
| JP | 03-147446 | A | 6/1991 |
| JP | 05-077456 | | 3/1993 |
| JP | 05-199044 | | 8/1993 |
| JP | 09-234865 | A | 9/1997 |
| JP | 09-300618 | A | 11/1997 |
| JP | 09-308264 | | 11/1997 |
| JP | 10-081013 | | 3/1998 |
| JP | 10-210757 | A | 8/1998 |
| JP | 11-058733 | A | 3/1999 |
| JP | 11-204850 | | 7/1999 |
| JP | 11-204850 | A | 7/1999 |
| JP | 2000-117980 | A | 4/2000 |
| JP | 2000-238262 | | 9/2000 |
| JP | 2000-245162 | | 9/2000 |
| JP | 2001-121697 | | 5/2001 |
| JP | 2001-268922 | A | 9/2001 |
| JP | 2002-204595 | A | 7/2002 |
| JP | 2002-210958 | A | 7/2002 |
| JP | 2002-536903 | A | 10/2002 |
| JP | 2003-001824 | | 1/2003 |
| JP | 2003-237068 | | 8/2003 |
| JP | 2004-048886 | A | 2/2004 |
| JP | 2004-255789 | A | 9/2004 |
| JP | 2004-306434 | | 11/2004 |
| JP | 2005-035062 | | 2/2005 |
| JP | 2005-065068 | | 3/2005 |
| JP | 2005-075475 | | 3/2005 |
| JP | 2005-131928 | | 5/2005 |
| JP | 2005-322957 | | 11/2005 |
| JP | 2005-329710 | | 12/2005 |
| JP | 2006-025151 | | 1/2006 |
| JP | 2006-035629 | A | 2/2006 |
| JP | 2006-231882 | | 9/2006 |
| JP | 2006-256151 | | 9/2006 |
| JP | 2006-272907 | | 10/2006 |
| JP | 2006-272907 | A | 10/2006 |
| JP | 2006-304490 | A | 11/2006 |
| JP | 2007-069555 | | 3/2007 |
| JP | 2007-096364 | | 4/2007 |
| JP | 2007-144867 | | 6/2007 |
| JP | 2007-152625 | A | 6/2007 |
| JP | 2007-168172 | | 7/2007 |
| JP | 2007-175613 | A | 7/2007 |
| JP | 2007-190708 | | 8/2007 |
| JP | 2008-049698 | | 3/2008 |
| JP | 2008-049699 | | 3/2008 |
| JP | 2008-087467 | | 4/2008 |
| WO | 00/46919 | A2 | 8/2000 |

OTHER PUBLICATIONS

U.S. Appl. No. 12/161,148, Sep. 16, 2010, Final Office Action.
U.S. Appl. No. 12/161,201, Sep. 28, 2010, Office Action.
U.S. Appl. No. 12/509,915, Sep. 30, 2010, Office Action.
U.S. Appl. No. 12/637,412, Aug. 23, 2010, Office Action.
U.S. Appl. No. 12/752,367, Oct. 8, 2010, Office Action.
U.S. Appl. No. 12/161,201, filed Jul. 17, 2008, Oshima et al.
U.S. Appl. No. 12/752,367, filed Apr. 1, 2010, Oshima.
U.S. Appl. No. 11/780,301, Jun. 27, 2008, Office Action.
U.S. Appl. No. 11/780,301, Feb. 20, 2009, Final Office Action.
U.S. Appl. No. 11/780,301, Jun. 16, 2009, Notice of Allowance.
U.S. Appl. No. 11/780,357, Oct. 28, 2009, Office Action.
U.S. Appl. No. 11/780,357, May 12, 2010, Final Office Action.
U.S. Appl. No. 11/780,390, Apr. 8, 2009, Notice of Allowance.
U.S. Appl. No. 11/849,582, May 28, 2008, Office Action.
U.S. Appl. No. 11/849,582, Dec. 30, 2009, Final Office Action.
U.S. Appl. No. 11/849,582, Apr. 19, 2010, Notice of Allowance.
U.S. Appl. No. 11/923,448, Nov. 27, 2009, Office Action.
U.S. Appl. No. 11/923,448, Apr. 28, 2010, Final Office Action.
U.S. Appl. No. 11/780,379, Mar. 3, 2010, Office Action.
U.S. Appl. No. 12/351,472, Jan. 4, 2010, Notice of Allowance.
U.S. Appl. No. 12/340,940, Apr. 12, 2010, Notice of Allowance.
U.S. Appl. No. 12/161,148, Mar. 30, 2010, Office Action.
Notice of Allowance dated Jun. 14, 2011 as related U.S. Appl. No. 12/637,412.
Office Action dated Jun. 14, 2011 as related U.S. Appl. No. 12/026,129.
Final Office Action dated Jun. 15, 2011 as related U.S. Appl. No. 12/027,175.
European Search Report dated Jan. 28, 2010 related European Application No. 077 06915.1.
Office Action dated Mar. 4, 2011 as related U.S. Appl. No. 11/780,357.
Office Action dated Mar. 4, 2011 as related U.S. Appl. No. 11/780,379.
Office Action dated Dec. 27, 2010 as related U.S. Appl. No. 12/026,129.
Office Action dated Dec. 27, 2010 as related U.S. Appl. No. 12/027,175.
Office Action dated Nov. 30, 2010 as related U.S. Appl. No. 12/689,926.

Notice of Allowance dated Apr. 5, 2010 as related U.S. Appl. No. 11/972,542.
Notice of Allowance dated Dec. 17, 2010 as related U.S. Appl. No. 12/498,296.
U.S. Office Action dated Oct. 11, 2011 as U.S. Appl. No. 12/624,206.
Japan Office Action dated Nov. 1, 2011 application No. 2007-181649.
United States Office Action dated Oct. 27, 2011 as U.S. Appl. No. 12/158,591.
United States Notice of Allowance dated Nov. 25, 2011 as U.S. Appl. No. 12/637,412.
United States Notice of Allowance mailed Jan. 13, 2012 as U.S. Appl. No. 12/161,201.
United States Office Action dated Apr. 14, 2011 as U.S. Appl. No. 12/161,201.

* cited by examiner

LIQUID JET APPARATUS

BACKGROUND

1. Technical Field

The present invention relates to a liquid jet apparatus adapted to form predetermined characters and images by emitting microscopic droplets of liquids from a plurality of nozzles to form the microscopic particles (dots) thereof on a medium.

2. Related Art

An inkjet printer as one of liquid jet printing apparatuses using a liquid jet apparatus, which can generally provide low-price and high quality color prints with ease, has widely been spreading not only to offices but also to general users along with widespread of personal computers and digital cameras.

In the liquid jet printing apparatuses using the liquid jet apparatus, finer tone is required. The tone denotes a state of density of each color included in a pixel expressed by a liquid dot, the size of the dot corresponding to the color depth of a pixel is called a tone grade, and the number of tone grades which can be expressed by the dot is called a tone number. The fine tone denotes that the tone number is large. In order for changing the tone grade, it is required to modify a drive signal to an actuator provided to a liquid jet head. In the case in which a piezoelectric element is used as the actuator, since an amount of displacement (distortion) of the piezoelectric element (a diaphragm, to be precise) becomes large when a voltage value applied to the piezoelectric element becomes large, the tone grade of the liquid dot can be changed using this phenomenon.

Therefore, in JP-A-5-77456, it is arranged that a plurality of drive pulses power-amplified by an analog power amplifier and having different voltage wave heights are combined and joined to generate the drive signal, the drive signal is output from a control device commonly to the actuators of the nozzles of the same color provided to the liquid jet head, a drive pulse corresponding to the tone grade of the liquid dot to be formed is selected from the drive signal for each nozzle, and the selected drive pulses are supplied to the corresponding actuators to emit a jet of the liquid, thereby achieving the required tone grade of the dot. On the other hand, the analog power amplifier has large circuit loss, and needs some measures against heat generation or the like. Therefore, in JP-A-11-204850, the measures against heat generation can be eliminated by using a digital power amplifier with small circuit loss to amplify the drive signal.

However, in such a case as to perform printing with a line head-type printing apparatus, since it is required to drive a number of actuators with a common drive signal, the current value of the drive signal becomes larger. In the case of interposing an electric wire or a flexible flat cable (FFC) on an output terminal of the drive signal to the liquid jet head, if the current value of the drive signal is larger, the loss and the heat generation become larger, and therefore, it is required to use those having a conductor with a larger cross-sectional area, which not only incurs growth in size of the apparatus but also causes a problem of electromagnetic noise generation. Further, in the case in which the length of the electric wire or the FFC for outputting the drive signal to the liquid jet apparatus is larger, there is caused a problem that waveform distortion of the drive signal is generated due to the parasitic inductance or the like, thus the liquid jet characteristic is varied.

SUMMARY

An object of the invention is to sweep out the problems related to the electric wire and the FFC for outputting the drive signal to the actuator, and in particular to provide a liquid jet apparatus capable of preventing the waveform distortion of the drive signal and of reducing the circuit size.

A liquid jet apparatus according to the invention is a liquid jet apparatus adapted to emit a jet of a liquid by driving an actuator of a liquid jet head with a drive signal including a digital power amplifier and a low pass filter provided to the liquid jet head so as to correspond to the actuator, and adapted to power-amplify and smooth a modified signal from a control circuit to form the drive signal, wherein the low pass filter is coupled directly with the actuator, and the digital power amplifier is provided with a pair of switching elements and a gate drive circuit, and ON-OFF controls the gate drive circuit based on print data, thereby performing one of output and halt of the drive signal.

According to the liquid jet apparatus of the invention, since the digital power amplifier and the low pass filter corresponding to each actuator are provided to the liquid jet head, the electric wire or the FFC for outputting the drive signal to the actuator can be eliminated or made necessity minimum, and therefore, the problems related thereto can be swept out, and further, in the case in which the actuator is a capacitive load, deformation of the waveform of the drive signal can be prevented because the drive signal is applied from the digital power amplifier only to that actuator via the low pass filter. Further, since the output or halt of the drive signal can be performed by ON-OFF controlling the gate drive circuit of the digital power amplifier, it is not necessary to dispose the selection switch for performing ON-OFF of the actuator on the upstream side of the drive signal of the actuator, and the circuit size can be reduced accordingly.

Further, in the liquid jet apparatus according to the invention the control circuit includes a memory adapted to store drive waveform data of a drive waveform signal forming a basis of a signal for controlling driving of the actuator, a drive waveform generator adapted to generate the drive waveform signal from the drive waveform data, and a modulator adapted to pulse-modulate the drive waveform signal to form a modulated signal, the digital power amplifier power-amplifies the modulated signal to form an amplified digital signal, and the low pass filter smoothes the amplified digital signal to form the drive signal.

According to the liquid jet apparatus of the invention, it becomes possible to store the drive waveform data suitable for the liquid jet characteristics of the respective nozzle lines or the respective nozzles in the memory, and by applying the drive waveform signals or the drive signals corresponding to the drive waveform data to the actuators, it becomes possible to make the liquid jet characteristics of the respective nozzle lines or the respective nozzles constant.

Further, in the liquid jet apparatus according to the invention the memory stores drive waveform data of respective nozzle lines, the drive waveform generator generates the drive waveform signals for the respective nozzle lines, and the modulator obtains the modulated signals for the respective nozzle lines by pulse modulation.

According to the liquid jet apparatus of the invention, by storing the drive waveform data suitable for the liquid jet characteristics of the respective nozzle lines apt to be generated on the grounds of manufacturing, the liquid jet characteristics of the respective nozzle lines can be made constant.

Further, in the liquid jet apparatus according to the invention the memory stores drive waveform data of respective nozzles, the drive waveform generator generates the drive waveform signals for the respective nozzles, and the modulator obtains the modulated signals for the respective nozzles by pulse modulation.

According to the liquid jet apparatus of the invention, by storing the drive waveform data suitable for the liquid jet characteristics of the respective nozzles, the liquid jet characteristics of the respective nozzles can be made constant.

Further, in the liquid jet apparatus according to the invention the modulator performs one of pulse width modulation and pulse density modulation.

DESCRIPTION OF EXEMPLARY EMBODIMENTS

A first embodiment of a liquid jet printing apparatus using a liquid jet apparatus of the invention will hereinafter be explained.

Figure 1:
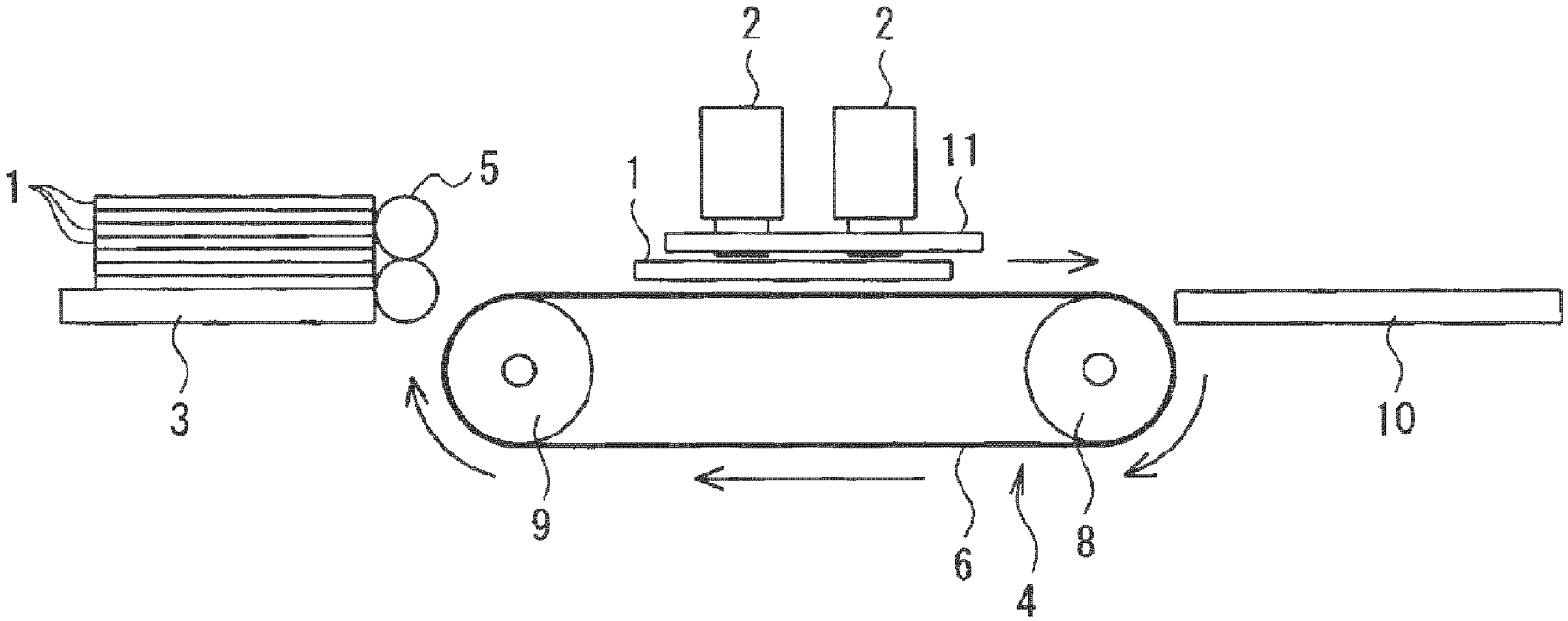
FIG. 1 is a front view of a schematic configuration showing a first embodiment of a liquid jet printing apparatus using a liquid jet apparatus of the invention.

FIG. 1 is a schematic configuration diagram of the liquid jet printing apparatus of the first embodiment, and in FIG. 1, in the line head-type printing apparatus, a print medium 1 is conveyed from the left to the right of the drawing in the arrow direction, and printed in a printing area during the conveying operation.

Figure 2:
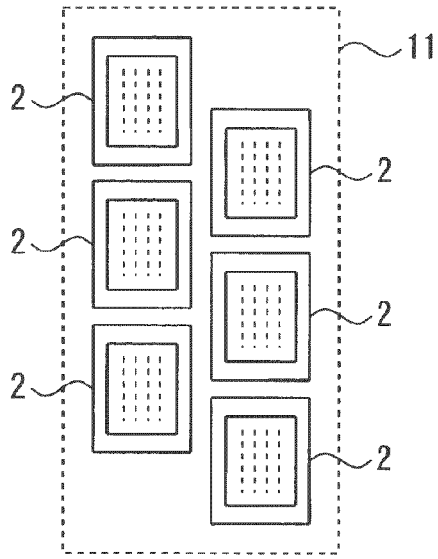
FIG. 2 is a plan view of a vicinity of a liquid jet head used in the liquid jet apparatus shown in FIG. 1.

The reference numeral 2 shown in FIG. 1 denotes six liquid jet heads disposed above a conveying line of the print medium 1, which are fixed individually to a head fixing plate 11 in a manner of forming two lines in the print medium conveying direction and being arranged in a direction perpendicular to the print medium conveying direction. FIG. 2 is a plan view of the liquid jet head 2.

Figure 3:
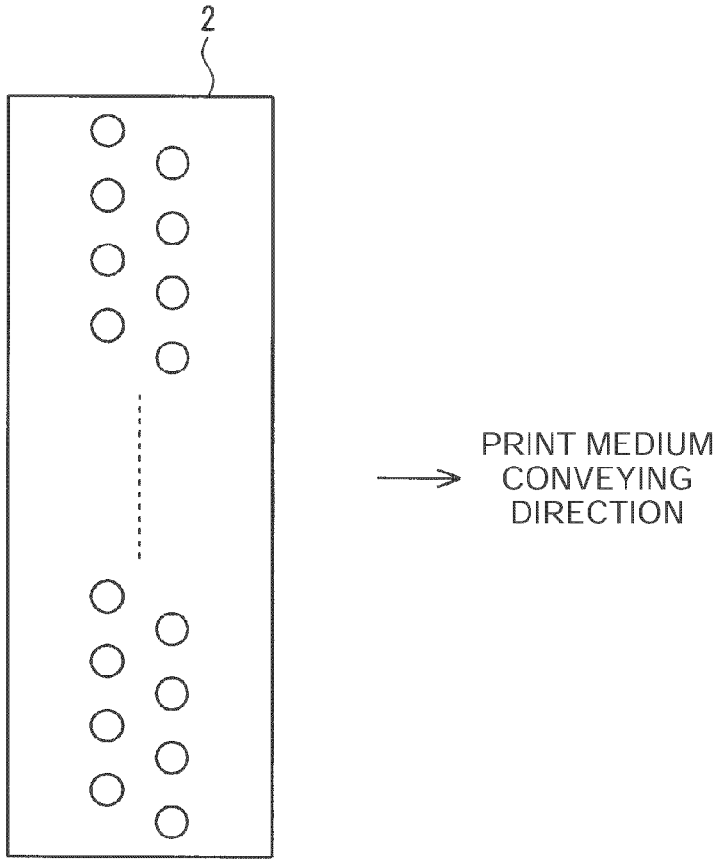
FIG. 3 is a detail view of a nozzle surface of the liquid jet head shown in FIG. 2.

The liquid jet heads 2 are provided with a number of nozzles, and the surface thereof is called a nozzle surface. A line head extending over the entire length in the direction traversing the conveying direction of the print medium 1 is formed of the liquid jet heads 2. When the print medium 1 passes through under the nozzle surface of the liquid jet head 2, a liquid jet is emitted from the number of nozzles provided to the nozzle surface, and printing is performed. FIG. 3 shows details of the nozzles provided to the nozzle surface of the liquid jet head 2. In the liquid jet head 2 of the first embodiment, the nozzles are opened on the nozzle surface in a zigzag manner. By thus opening the nozzles in a zigzag manner, it is possible to reduce the distance between the nozzles adjacent to each other in a direction traversing the print medium conveying direction, namely a so-called pixel pitch.

The liquid jet head 2 is supplied with liquids such as ink of four colors of yellow (Y), magenta (M), cyan (C), and black (K) from liquid tanks of respective colors not shown via liquid supply tubes. The liquid jet heads 2 are each provided with a plurality of nozzles formed in the direction perpendicular to the conveying direction of the print medium 1, and emit a necessary amount of liquid jet from the respective nozzles simultaneously to the necessary positions, thereby forming microscopic dots on the print medium 1. By executing the above for each of the colors, one-pass printing can be performed only by making the print medium 1 conveyed by a conveying section 4 pass through once.

As a method of emitting a liquid jet from the nozzles of the liquid jet head 2, there are cited an electrostatic driving method, a piezoelectric driving method, a film boiling liquid jet method, and so on, and in the first embodiment there is used the piezoelectric driving method. In the piezoelectric driving method, when a drive signal is provided to a piezoelectric element as an actuator, a diaphragm in a cavity is displaced to cause pressure variation in the cavity, and the liquid jet is emitted from the nozzle in response to the pressure variation. Further, by controlling the wave height and the voltage variation gradient of the drive signal, it becomes possible to control the amount of liquid jet to be emitted therefrom. It should be noted that the piezoelectric element used in the piezoelectric driving method is a capacitive load. Further, the invention can also be applied to liquid jet methods other than the piezoelectric driving method.

Under the liquid jet head 2, the conveying section 4 for conveying the print medium 1 in the conveying direction is disposed. The conveying section 4 is configured by winding a conveying belt 6 around a drive roller 8 and a driven roller 9, and an electric motor not shown is coupled to the drive roller 8. Further, in the inside of the conveying belt 6, there is disposed an absorption apparatus, not shown, for absorbing the print medium 1 on the surface of the conveying belt 6. For the absorption apparatus there is used an air suction apparatus for absorbing the print medium 1 to the conveying belt 6 with negative pressure, or an electrostatic absorption apparatus for absorbing the print medium 1 to the conveying belt 6 with electro static force. Therefore, when a feed roller 5 feeds just one sheet of the print medium 1 on the conveying belt 6 from a feeder section 3, and then the electric motor rotationally drives the drive roller 8, the conveying belt 6 is rotated in the print medium conveying direction, and the print medium 1 is conveyed while being absorbed to the conveying belt 6 by the absorption apparatus. During this conveying operation, printing is performed by emitting liquid jets from the liquid jet head 2. The print medium 1 on which printing is completed is ejected to a catch tray 10 disposed on the downstream side in the conveying direction.

Figure 4:
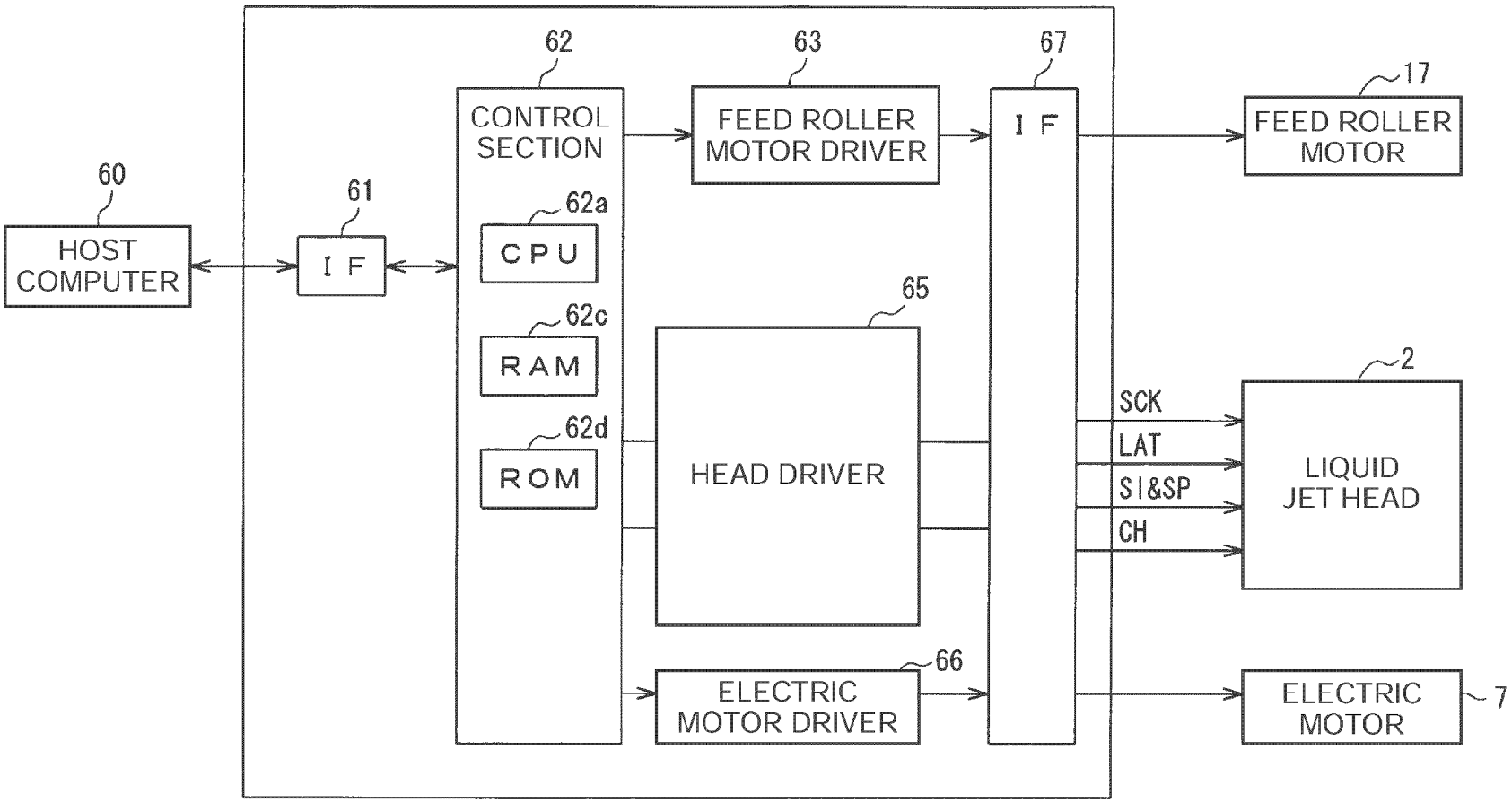
FIG. 4 is a block diagram of a control device of the liquid jet printing apparatus shown in FIG. 1.

Inside the liquid jet printing apparatus, there is provided a control apparatus for controlling the liquid jet printing apparatus. As shown in FIG. 4, the control apparatus is configured including an input interface 61 for receiving print data input from a host computer 60, a control section 62 configured with a microcomputer for executing a print process in accordance with the print data input from the input interface 61, a feed roller motor driver 63 for controlling driving of a feed roller motor 17 coupled to the feed roller 5, a head driver 65 for controlling driving of the liquid jet head 2, an electric motor driver 66 for controlling driving of an electric motor 7 coupled to the drive roller 8, and an interface 67 for connecting the feed roller motor driver 63, the head driver 65, and the electric motor driver 66, to the feed roller motor 17, the liquid jet head 2, and the electric motor 7, respectively.

The control section 62 is provided with a central processing unit (CPU) 62*a* for performing various processes such as a printing process, a random access memory (RAM) 62*c* for temporarily stores the print data input via the input interface 61 and various kinds of data used when performing the printing process, and for temporarily developing a program, for example, for the printing process, and a read-only memory (ROM) 62*d* formed of a nonvolatile semiconductor memory and for storing, for example, the control program executed by the CPU 62*a*. When the control section 62 receives the print data (the image data) from the host computer 60 via the interface 61, the CPU 62*a* executes a predetermined process on the print data to calculate nozzle selection data (drive pulse selection data) regarding which nozzle emits the liquid jet or how much liquid jet is to be emitted, and outputs the drive signals and the control signals to the feed roller motor driver 63, the head driver 65, and the electric motor driver 66, respectively, based on the print data, drive pulse selection data, and input data from various sensors.

In accordance with these control signals, the feed roller motor 17 and the electric motor 7 operate individually, thereby executing feeding, conveying, and ejection of the print medium 1, and the printing process on the print medium 1. It should be noted that, in the first embodiment, as described later, since the control circuit and the drive circuit are also disposed in the inside of each of the liquid jet heads 2, only the control signals are output from the head driver 65 to the liquid jet heads 2. Further, the constituents inside the control section 62 are electrically connected to each other via a bus not shown in the drawings.

Figure 5:
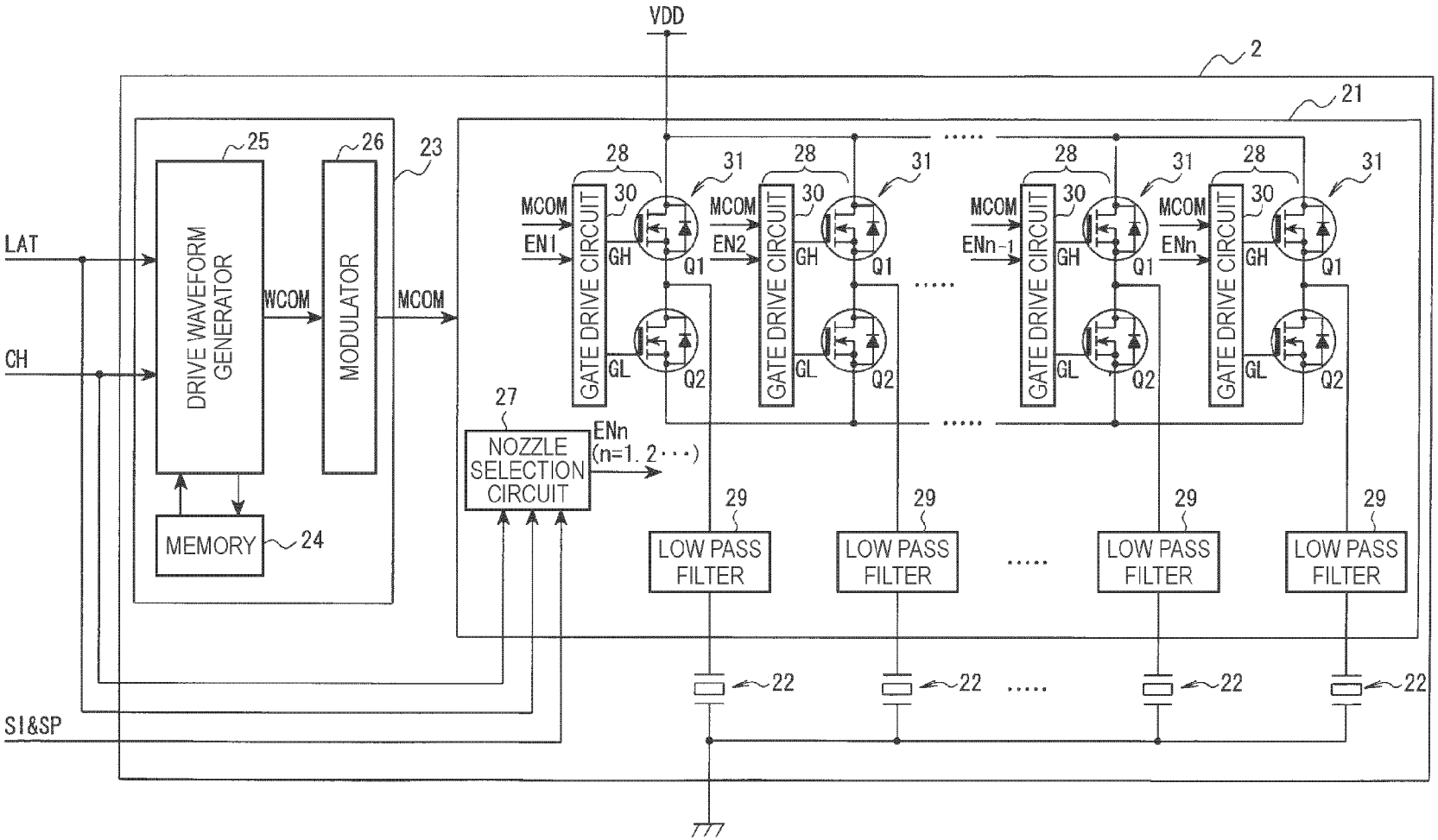
FIG. 5 is a block diagram of a control circuit and a drive circuit provided to the liquid jet head.

FIG. 5 shows specific configurations of the control circuit and the drive circuit built inside the liquid jet head 2. The reference numeral 22 in FIG. 5 denotes the actuators each composed of a piezoelectric element or the like. Among them, a control circuit 23 is configured with a microcomputer or the like, and executes a unique arithmetic process to output a modulated signal, and a drive circuit 21 power-amplifies the modulated signal to create and output the drive signals to the actuators 22. The control circuit 23 is configured including a memory 24 for storing drive waveform data for creating and outputting the drive signals and program of the arithmetic process, a drive waveform generator 25 for generating a drive waveform signal WCOM forming a bases of the drive signals, namely a basis of signals for controlling driving of the actuators 22 based on the drive waveform data described above, and a modulator 26 for pulse-modulating the drive waveform signal WCOM generated by the drive waveform generator 25.

Further, the drive circuit 21 is configured including digital power amplifiers 28 disposed so as to correspond respectively to the actuators 22 and for power-amplifying the modulated signal pulse-modulated by the modulator 26, and low pass filters 29 for individually smoothing amplified digital signals power-amplified by the digital power amplifiers 28 and respectively supplying the actuators 22 with the signals as the drive signals COM (the drive pulses PCOM).

The drive waveform generator 25 reads out the drive waveform data stored in the memory 24 at a predetermined sampling period, then converts it into a voltage signal to hold it for the predetermined sampling period, and analog-converts it with a D/A converter to output it as the drive waveform signal WCOM. In the first embodiment, as the modulator 26 for performing the pulse modulation on the drive waveform signal WCOM, there is used a typical pulse width modulation (PWM) circuit. In the pulse width modulation, as well known to the public, the triangular wave generator generates a triangular wave signal with a predetermined frequency, and a comparator compares the triangular wave signal with the drive waveform signal WCOM to output a pulse signal as the modulated signal MCOM, which takes on-duty when the drive waveform signal WCOM is greater than the triangular wave signal. It is also possible to use a pulse density modulation (PDM) circuit as the modulator 26.

The digital power amplifier 28 is configured including a half-bridge output stage 31 formed of a high-side switching element Q1 and a low-side switching element Q2 for substantially amplifying the power, and a gate drive circuit 30 for controlling gate-source signals GH, GL of the switching elements Q1, Q2 based on the modulated signal from the modulator 26. Further, the low pass filter 29 is formed of a low pass filter (a low-frequency pass filter) composed of a combination of an inductor and a capacitor, and the low pass filter eliminates the modulation period component of the amplified digital signal, namely the frequency component (the carrier component) of the triangular wave signal in this case.

In the digital power amplifier 28, when the modulated signal MCOM is in the high level, the gate-source signal GH of the high-side switching element Q1 output from the gate drive circuit 30 becomes in the high level and the gate-source signal GL of the low-side switching element Q2 becomes in the low level, and consequently, the high-side switching element Q1 becomes in the ON state and the low-side switching element Q2 becomes in the OFF state, and as a result, the output of the half-bridge output stage 31 becomes the supply power VDD. On the other hand, when the modulated signal MCOM is in the low level, the gate-source signal GH of the high-side switching element Q1 becomes in the low level and the gate-source signal GL of the low-side switching element Q2 becomes in the high level, and consequently, the high-side switching element Q1 becomes in the OFF state and the low-side switching element Q2 becomes in the ON state, and as a result, the output of the half-bridge output stage 31 becomes 0.

Although a current flows through the switching element in the ON state when the high-side switching elements Q1 and low-side switching element Q2 are driven digitally as described above, the resistance value between the drain and the source is extremely small, and therefore, the loss is hardly caused. Further, since no current flows in the switching element in the OFF state, the loss is not caused. Therefore, since the loss of the digital power amplifier 28 is extremely small, a switching element such as a small-sized MOSFET can be used therefor, and cooling means such as a heat radiation plate for cooling can also be eliminated. Incidentally, the efficiency in the case of driving the transistor in the linear range is about 30% while the efficiency of digital power amplifier 28 is 90% or higher. Further, since the heat radiation plate for cooling the transistor requires about 60 mm square in size for each transistor, if such a radiation plate for cooling can be eliminated, an overwhelming advantage in the actual layout can be obtained.

Figure 6:
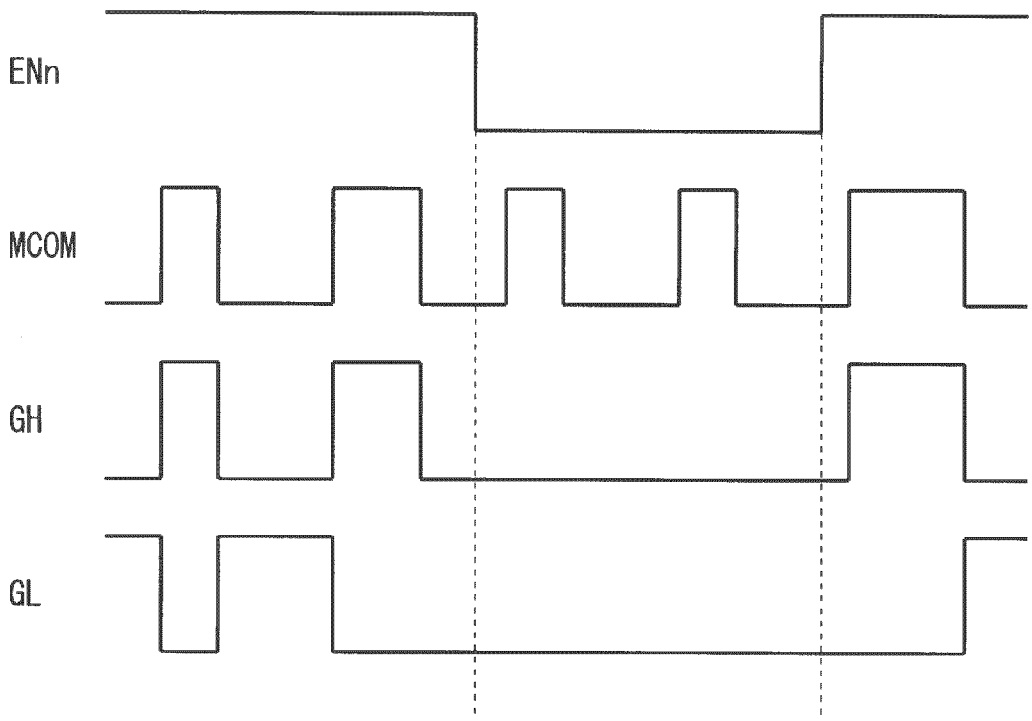
FIG. 6 is an explanatory diagram showing a relationship between a nozzle selection signal and a gate-source signal.

It should be noted that in the first embodiment the low pass filter 29 disposed on the output side of the digital power amplifier 28 and the actuator 22 are directly connected without interposing a selection switch such as a transmission gate therebetween. Further, as shown in FIG. 6, although the gate-source signals GH, GL are output to the gate drive circuit 30 of the first embodiment in accordance with the modulated signal MCOM when a nozzle selection signal ENn described later is in the high level, when the nozzle selection signal ENn is in the low level, the low level is output on either of the gate-source signals GH, GL. In other words, when the gate drive circuit 30 is in the OFF state, the drive signal to the actuator 22 is halted, and the drive signal to the actuator 22 is output only when the gate drive circuit 30 is in the ON state.

Figure 7:
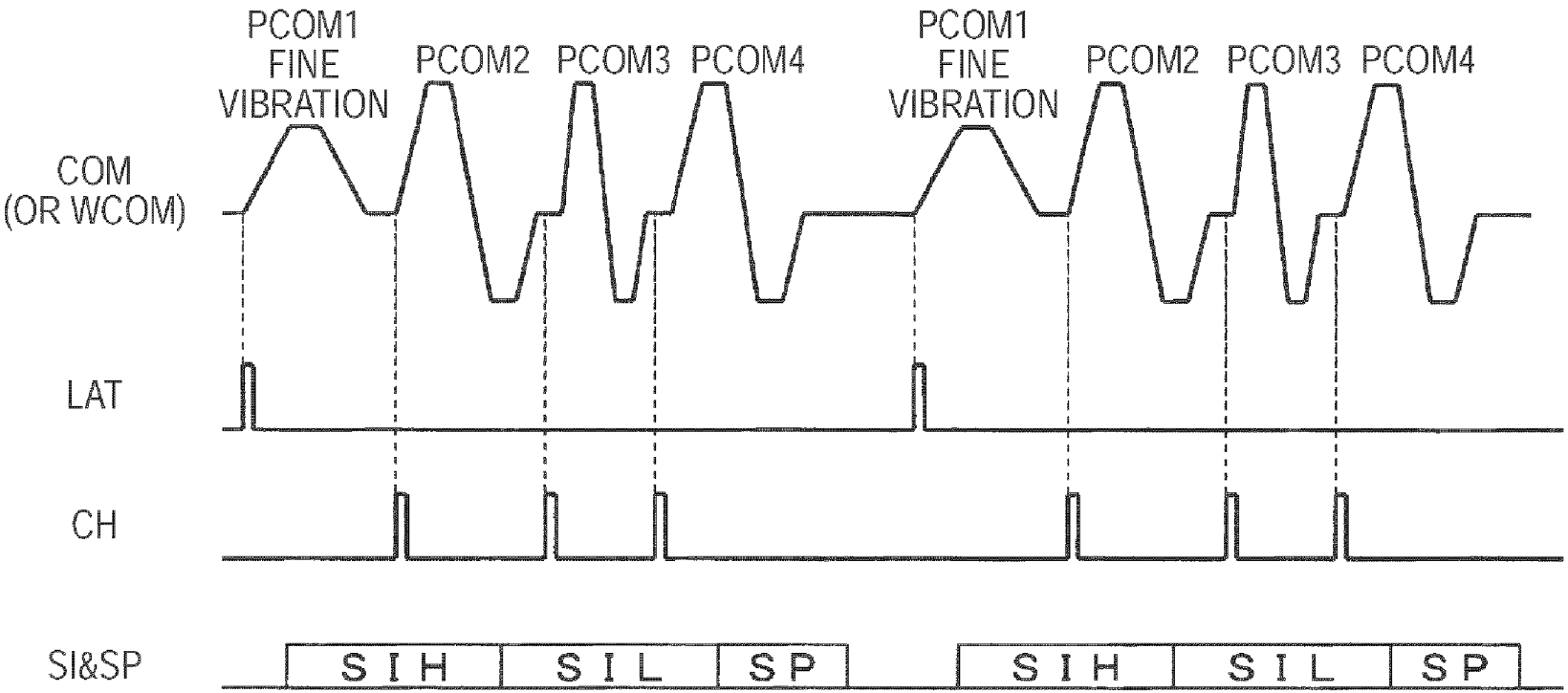
FIG. 7 is an explanatory diagram for a drive signal for driving an actuator in the liquid jet head.

FIG. 7 shows an example of the drive signal COM supplied from the control apparatus of the printing apparatus according to the first embodiment to the liquid jet heads 2, and for driving the actuators 22 each formed of a piezoelectric element. In the first embodiment, it is assumed that the signal has the electric potential varying around a midpoint potential. The drive signal COM is formed by connecting, in a time-series manner, the drive pulses PCOM as unit drive signals for driving the actuator 22 so as to emit a liquid jet, wherein the rising section of each of the drive pulses PCOM corresponds to a stage of expanding the volume of the cavity (the pressure chamber) which communicates with the nozzle, to pull in the liquid (it can also be said that the meniscus is pulled in, in view of the surface of the liquid to be emitted), the falling section of each of the drive pulses PCOM corresponds to a stage of reducing the volume of the cavity to push out the liquid (it can also be said that the meniscus is pushed out, in view of the surface of the liquid to be emitted), and as a result of pushing out the liquid, the liquid jet is emitted from the nozzle.

By variously modifying the gradient of increase and decrease in voltage and the height of the drive pulse PCOM formed of this trapezoidal voltage wave, the pull-in amount and the pull-in speed of the liquid, and the push-out amount and the push-out speed of the liquid can be modified, thus the amount of liquid jet can be varied to obtain the liquid dots with different sizes. Therefore, even in the case in which a plurality of drive pulses PCOM are sequentially joined, it is possible to select the single drive pulse PCOM from the drive pulses to be supplied to the actuator to emit the liquid jet, or to select the two or more drive pulses PCOM to be supplied to the actuator to emit the liquid jet two or more times, thereby obtaining the dots with various sizes.

In other words, when the two or more liquid droplets land on the same position before the liquid is dried, it brings substantially the same result as emitting a larger amount of liquid jet, thus the size of the dot can be enlarged. By a combination of such technologies, it becomes possible to achieve multiple tone printing. It should be noted that a drive pulse PCOM1 shown in the left end of FIG. 7 is only for pulling in the liquid without pushing out the liquid. This is called a fine vibration, and is used for preventing thickening in the nozzle without emitting the liquid jet.

From the control apparatus shown in FIG. 4 to each of the liquid jet heads 2, as the control signals, there are input drive pulse selection data SI&SP for selecting the nozzle to emit the liquid jet and determining the coupling timing of the actuator 22 such as a piezoelectric element to the drive signal COM based on the print data, the latch signal LAT and a channel signal CH for coupling the drive signals COM with the actuators 22 of the liquid jet head 2 to each other based on the drive pulse selection data SI&SP after the nozzle selection data is input to all of the nozzles, and the clock signal SCK for transmitting the drive pulse selection data SI&SP to the liquid jet head 2 as a serial signal. It should be noted that it is hereinafter assumed that the minimum unit of the drive signal for driving the actuator 22 is the drive pulse PCOM, and the entire signal having the drive pulses PCOM coupled with each other in a time series manner is described as the drive signal COM.

In other words, output of a string of drive signal COM is started in response to the latch signal LAT, and the drive pulse PCOM is output in response to each channel signal CH.

Further, the SI data is for designating whether or not the dot is formed and the dot size for each pixel, and the SP data is for designating which one of the plurality of drive pulses PCOM included in the drive signal COM is to be used for each dot size designated by the SI data.

In the nozzle selection circuit 27, the drive pulse selection data SI&SP for designating the actuator 22 such as the piezoelectric element corresponding to the nozzle to emit the liquid jet is stored while sequentially shifted from the first stage to the posterior stages of the storage area of the shift register in accordance with the input pulses of the clock signal SCK, and after the drive pulse selection data SI&SP corresponding to the number of nozzles is stored in the shift register, the output signals of the shift register are simultaneously latched by the latch signal LAT and the channel signal CH input thereto, those output signals are appropriately power-amplified, and output to the gate circuit 30 of the digital power amplifier 28 of the corresponding actuator 22 as the nozzle selection signal ENn (n=1, 2, . . . , n).

It is assumed that the symbol n representing the number of the nozzle (or the actuator) takes the value 1 as the uppermost nozzle shown in the drawing among the nozzles of the liquid jet head 2 shown in, for example, FIG. 3, the value 2 as the second uppermost nozzle, and the value n as the lowermost nozzle shown in the drawing. When the nozzle selection signal ENn is in the high level, the gate drive circuit 30 outputs the gate-source signals GH, GL in accordance with the modulated signal MCOM, and when it is in the low level, the low level is output on either of the gate-source signals GH, GL. It should be noted that in the subsequent latch period to the latch period in which a pair of drive pulse selection data SI&SP is input, the drive pulse PCOM is selected based on the pair of drive pulse selection data SI&SP.

Figure 8:
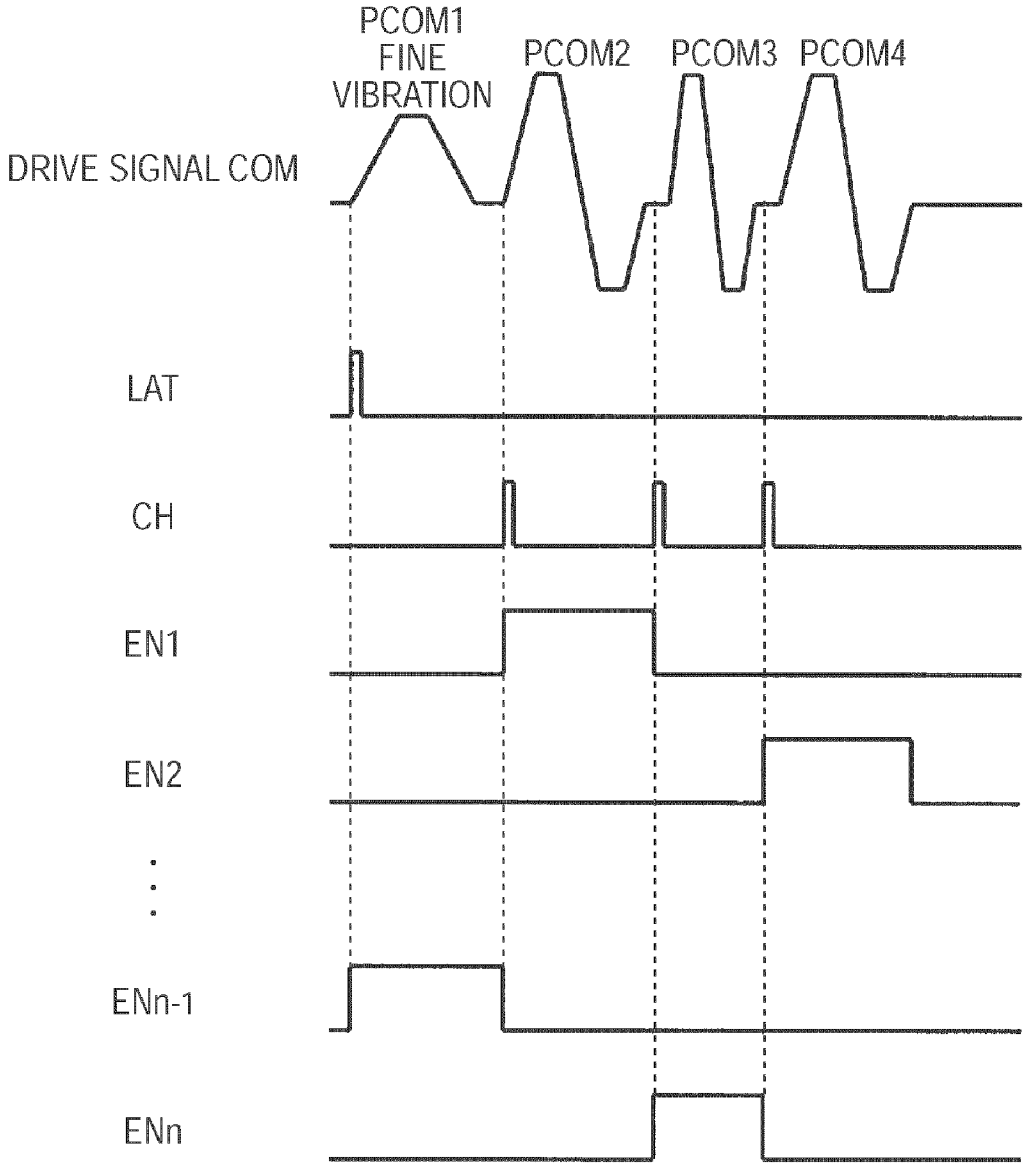
FIG. 8 is a timing chart of the drive signal and the nozzle selection signal by the control circuit and the drive circuit shown in FIG. 5.

FIG. 8 shows an example of the drive signal COM and the nozzle selection signal ENn of the first embodiment. In FIG. 8, a second drive pulse PCOM2 is applied to the actuator 22 of the nozzle with a number 1, a fourth drive pulse PCOM4 is applied to the actuator 22 of the nozzle with a number 2, the first drive pulse PCOM1 (the fine vibration) is applied to the actuator 22 of the nozzle with a number n−1, and a third drive pulse PCOM3 is applied to the actuator 22 of the nozzle with a number n.

As described above, according to the first embodiment, since the plurality of nozzles for emitting liquid jets are provided to the liquid jet head 2, each of the nozzles is provided with the actuator 22, and when each of the actuators 22 of the liquid jet head 2 is driven by the drive signal COM, thereby emitting the liquid jet from the corresponding nozzles towards the print medium 1, the digital power amplifier 28 for power-amplifying the control signal from the control circuit 23 to output to the actuator 22 as the drive signal COM and the low pass filter 29 are provided to the liquid jet head 2 so as to correspond to each of the actuators 22, it is possible to eliminate the electric wires and FFC for outputting the drive signals COM to the actuators 22 or to make the electric wires and FFC necessity minimum, and therefore, it is possible to sweep out the problems related thereto, and further, even in the case in which the actuator 22 is a capacitive load, the waveform deformation of the drive signal COM can be prevented since the drive signal COM applied to the actuator 22 from the digital power amplifier 28 via the low pass filter 29 is exclusively for that actuator 22.

Specifically, the low pass filter 29 is composed of a combination of an inductor and a capacitor. Since the actuator 22 is a capacitive load, and coupled in parallel with the capacitor of the low pass filter, in the case of outputting just one of the common drive signals COM and a plurality of actuators 22 are connected thereto, the characteristic of the low pass filter coupled with the drive signal COM is changed when the number of actuators 22 to be coupled thereto is varied, and as a result, the waveform of the drive signal COM is varied, and therefore, the liquid jet characteristic from each of the nozzles is also varied. In the case of the first embodiment, since each of the actuators 22 is provided with the digital power amplifier 28 and the low pass filter 29, and therefore, the number of actuators 22 coupled with one of the drive signals COM is one or zero, there is no chance for the waveform of the drive signal COM applied to the actuator 22 to vary, and the characteristic of the liquid jet from the nozzle is also prevented from varying.

Further, since the low pass filter 29 and the actuator 22 are coupled with each other directly, the digital power amplifier 28 is provided with a half-bridge output stage (a pair of switching elements) 31 and the date drive circuit 30, and the drive signal COM is output or halted by ON-OFF controlling the gate drive circuit 30 based on print data, it becomes possible to eliminate the selection switch for performing ON-OFF of the actuator 22 disposed on the drive signal upstream side of the actuator 22, and the circuit size can be reduced accordingly.

Figure 9:
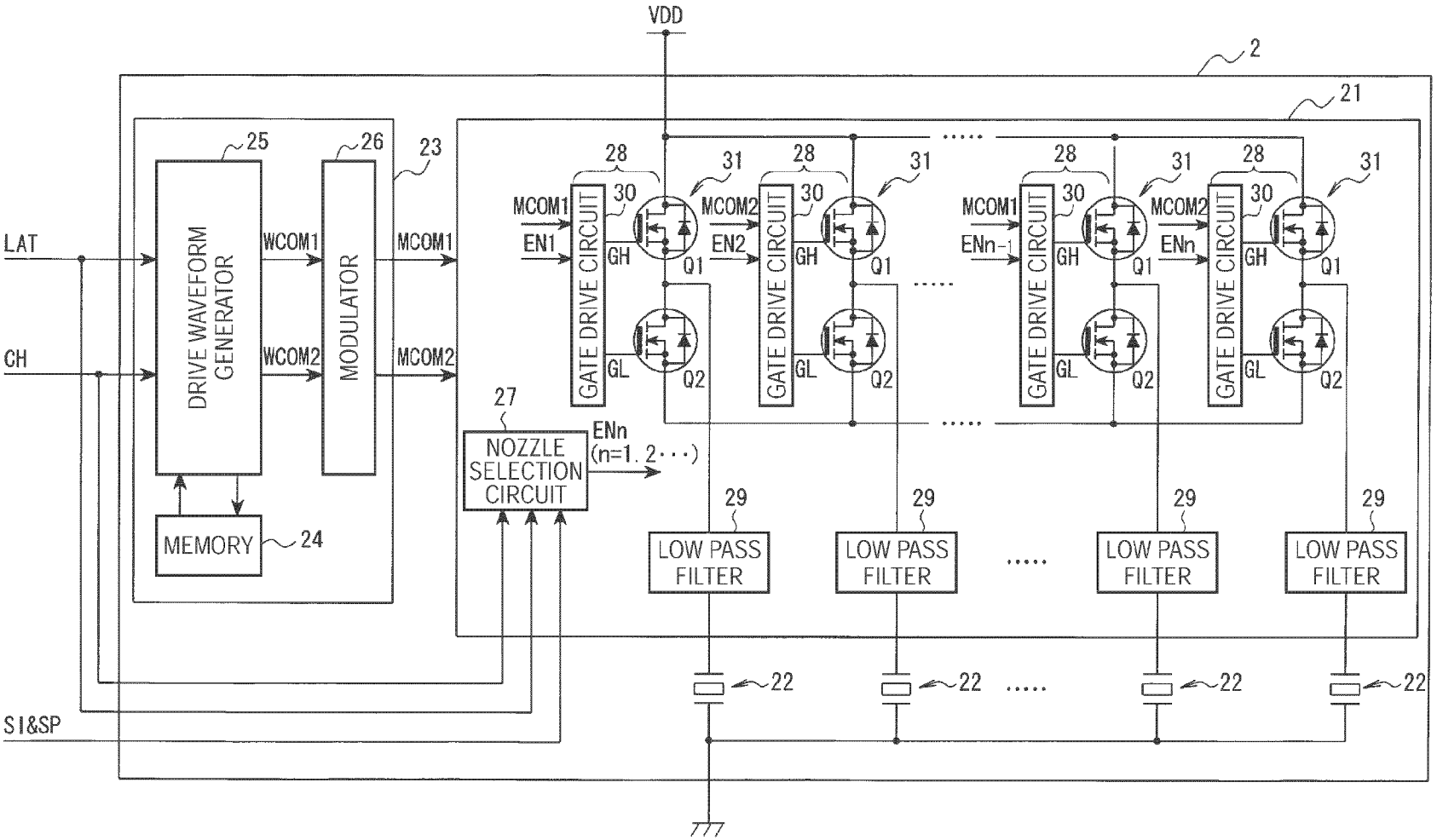
FIG. 9 is a block diagram of the control circuit and the drive circuit provided to the jet head showing a second embodiment of the liquid jet apparatus of the invention.

A second embodiment of a liquid jet printing apparatus using a liquid jet apparatus will hereinafter be explained. The configuration of the second embodiment is almost the same as that of the first embodiment described above, and is slightly different therefrom in the control circuit 23 and the drive circuit 21 disposed in the liquid jet head 2. FIG. 9 shows the configuration of the control circuit 23 and the drive circuit 21 disposed in the liquid jet head 2 of the second embodiment. Although the configuration itself of the control circuit 23 and the drive circuit 21 in the liquid jet head 2 of the second embodiment is the same as that of the first embodiment, the memory 24 stores two types of drive waveform data, the drive waveform generator 25 generates a first drive waveform signal WCOM1 and a second drive waveform signal WCOM2 corresponding respectively to those drive waveform data, and the modulator 26 outputs a first modulated signal MCOM1 and a second modulated signal MCOM2 obtained by individually pulse-modulating those drive waveform signals.

Further, the first modulated signal MCOM1 is input to the digital power amplifiers 28 of the actuators 22 with odd nozzle numbers n, and the second modulated signal MCOM2 is input to the digital power amplifiers 28 of the actuators 22 with even nozzle numbers n, in such a manner that the first modulated signal MCOM1 is input to the digital power amplifier 28 of the actuator 22 corresponding to the nozzle number 1, and the second modulated signal MCOM2 is input to the digital power amplifier 28 of the actuator 22 corresponding to the nozzle number 2. Since the maximum value of n is an even number, to the digital power amplifier 28 of the actuator 22 with the nozzle number n−1, the first modulated signal MCOM1 is input, and to the digital power amplifier 28 of the actuator 22 with the nozzle number n, the second modulated signal MCOM2 is input. The digital power amplifiers 28, to which the first modulated signal 1 is input, output a first drive signal COM1 via the low pass filters 29, while the digital power amplifiers 28, to which the second modulated signal 2 is input, output a second drive signal COM2 via the low pass filters 29.

According to FIG. 3, since the nozzle number n is set in such a manner that the uppermost nozzle number is 1, the second uppermost nozzle number is 2, the odd nozzle numbers n denote the nozzles in the left nozzle line shown in FIG. 3, and the even nozzle numbers denote the nozzles in the right nozzle line shown in FIG. 3. In the case in which nozzles are opened in a zigzag manner as shown in FIG. 3, the liquid jet characteristic is often different between the left and the right nozzle lines of the zigzag arrangement. This is caused on the grounds of manufacturing, and cannot easily be corrected. Therefore, in the second embodiment, the two types of drive waveform data suitable for the respective nozzle lines are stored in the memory 24, the first drive waveform signal WCOM1 and the second drive waveform signal WCOM2 corresponding respectively thereto are generated, the drive waveform signals are individually pulse-modulated to output the first modulated signal MCOM1 and the second modulated signal MCOM2, and the first drive signal COM1 corresponding thereto is applied to the actuators 22 of the left nozzle line shown in FIG. 3 while the second drive signal COM2 corresponding thereto is applied to the actuators 22 of the right nozzle line shown in FIG. 3.

Figure 10:
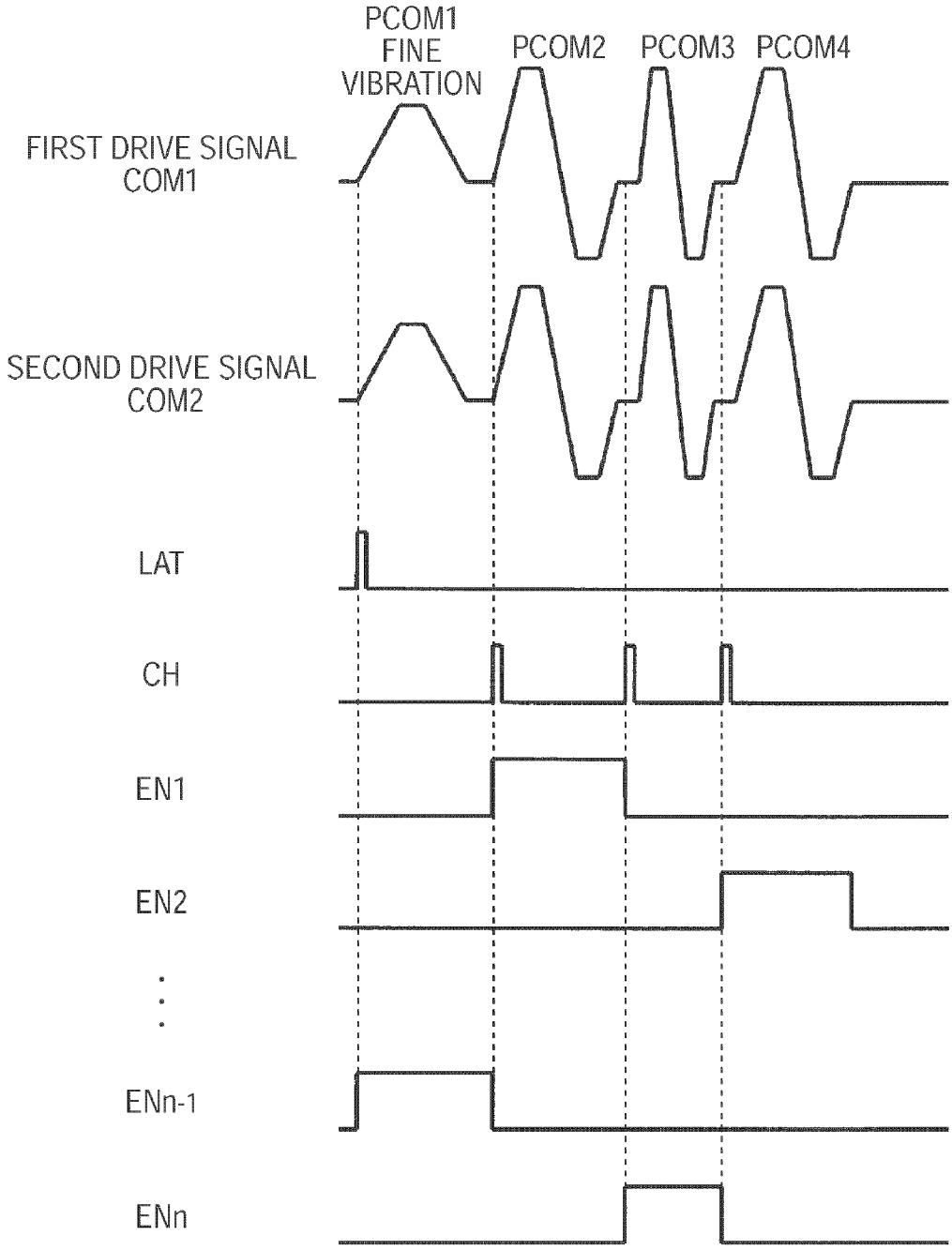
FIG. 10 is a timing chart of the drive signal and the nozzle selection signal by the control circuit and the drive circuit shown in FIG. 9.

FIG. 10 shows an example of the drive signal COM and the nozzle selection signal ENn of the second embodiment. In FIG. 10, the second drive pulse PCOM2 of the first drive signal COM1 is applied to the actuator 22 of the nozzle number 1 in the left nozzle line, the fourth drive pulse PCOM4 of the second drive signal COM2 is applied to the actuator 22 of the nozzle number 2 in the right nozzle line, . . . , the first drive pulse PCOM1 (the fine vibration) of the first drive signal COM1 is applied to the actuator 22 of the nozzle number n−1 in the left nozzle line, and the third drive pulse PCOM3 of the second drive signal COM2 is applied to the actuator 22 of the nozzle number n in the right nozzle line.

As described above, according to the second embodiment, since there is adopted the configuration in which the control circuit 23 is provided with the memory 24 for storing the drive waveform data of the drive waveform signal WCOM for forming the basis of the signal for controlling driving of the actuators 22, the drive waveform generator 25 for generating the drive waveform signal WCOM from the drive waveform data read out from the memory 24, and the modulator 26 for pulse-modulating the drive waveform signal WCOM generated by the drive waveform generator 25, and the digital power amplifier 28 power-amplifies the modulated signal MCOM pulse-modulated by the modulator 26, and the low pass filter 29 smoothes the amplified digital signal thus power-amplified by the digital power amplifier 28, and then supplies it to the actuator 22 as the drive signal COM, it becomes possible to store the drive waveform data suitable for the liquid jet characteristics of the respective nozzle lines or nozzles in the memory 24, and by applying the drive waveform signal WCOM or the drive signal COM, which corresponds to the drive waveform data, to the actuator 22, it becomes possible to make the liquid jet characteristics of the respective nozzle lines or the nozzles constant.

Further, since there is adopted the configuration in which the memory 24 stores the drive waveform data for the respective nozzle lines, the drive waveform generator 25 generates the drive waveform signals WCOM1, WCOM2 for the respective nozzle lines, and the modulator 26 obtains the modulated signals MCOM1, MCOM2 of the respective nozzle lines by the pulse-modulation, by storing the drive waveform data suitable for the liquid jet characteristics of the respective nozzle lines apt to be generated on the grounds of manufacturing, the liquid jet characteristics of the respective nozzle lines can be made constant.

Figure 11:
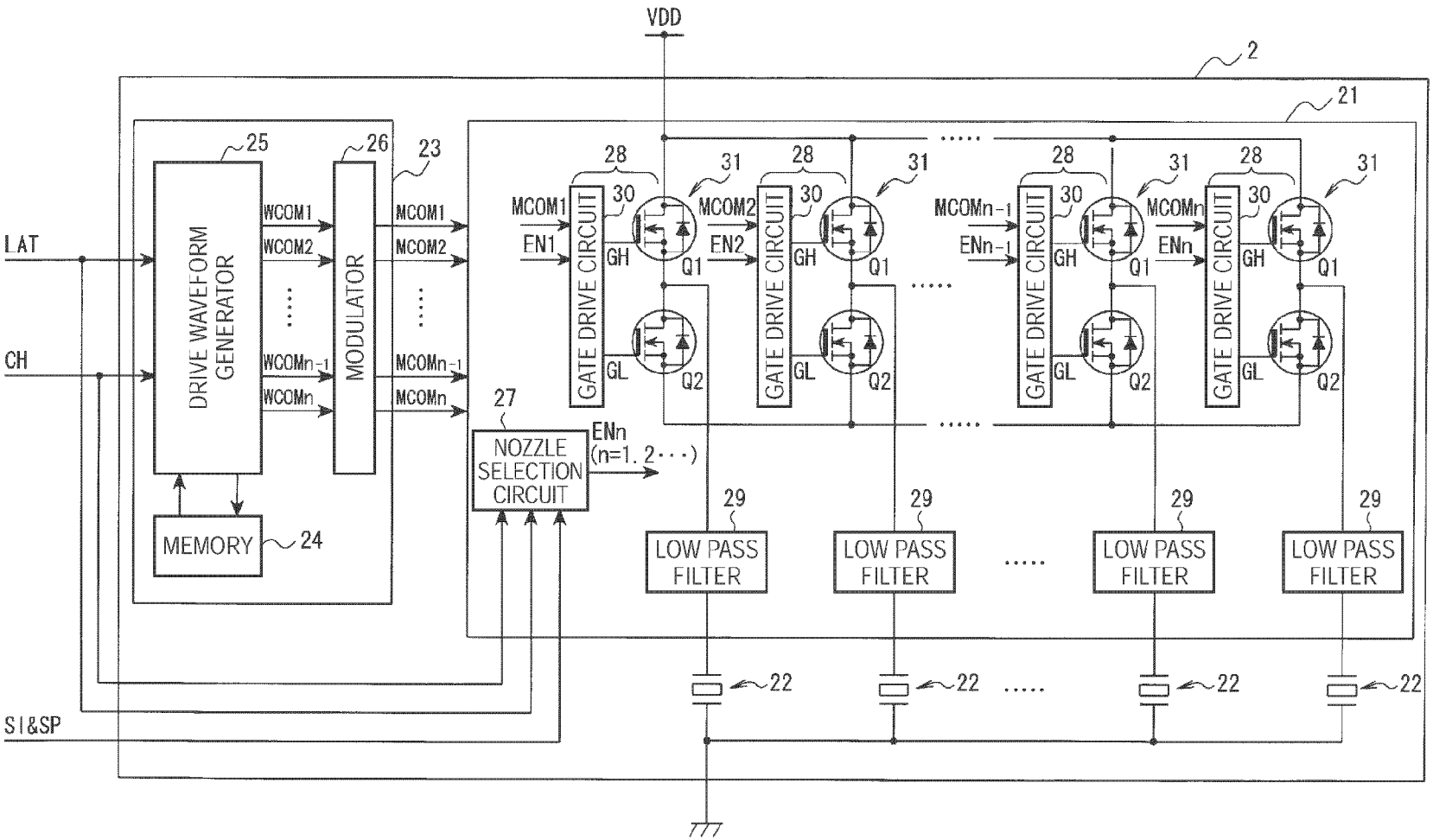
FIG. 11 is a block diagram of the control circuit and the drive circuit provided to the jet head showing a third embodiment of the liquid jet apparatus of the invention.

A third embodiment of a liquid jet printing apparatus using a liquid jet apparatus will hereinafter be explained. The configuration of the third embodiment is almost the same as those of the first and second embodiments described above, and is slightly different therefrom in the control circuit 23 and the drive circuit 21 disposed in the liquid jet head 2. FIG. 11 shows the configuration of the control circuit 23 and the drive circuit 21 disposed in the liquid jet head 2 of the third embodiment. Although the configuration itself of the control circuit 23 and the drive circuit 21 in the liquid jet head 2 of the third embodiment is the same as those of the first and second embodiments, the memory 24 stores the drive waveform data corresponding respectively to the number of all of nozzles provided to the liquid jet head 2, the drive waveform generator 25 generates a first drive waveform signal WCOM1 through an nth drive waveform signal WCOMn corresponding to those drive waveform data, and the modulator 26 outputs a first modulated signal MCOM1 through an nth modulated signal MCOMn obtained by individually pulse-modulating the drive waveform signals.

Further, the first modulated signal MCOM1 is input to the digital power amplifier 28 of the actuator 22 corresponding to the nozzle number 1, the second modulated signal MCOM2 is input to the digital power amplifier 28 of the actuator 22 corresponding to the nozzle number 2, . . . , the n−1th modulated signal MCOMn−1 is input to the digital power amplifier 28 of the actuator 22 corresponding to the nozzle number n−1, and the nth modulated signal MCOMn is input to the digital power amplifier 28 of the actuator 22 corresponding to the nozzle number n.

Further, the digital power amplifier 28, to which the first modulated signal MCOM1 is input, outputs the first drive signal COM1 via the low pass filter 29, the digital power amplifier 28, to which the second modulated signal MCOM2 is input, outputs the second drive signal COM2 via the low pass filter 29, the digital power amplifier 28, to which the n−1th modulated signal MCOMn−1 is input, outputs the n−1th drive signal COMn−1 via the low pass filter 29, and the digital power amplifier 28, to which the nth modulated signal MCOMn is input, outputs the nth drive signal COMn via the low pass filter 29.

Although in the second embodiment, the drive waveform data suitable for the respective nozzle lines is stored in the memory 24 in accordance with the variation in the liquid jet characteristic between the nozzle lines, which appears relatively prominently, the liquid jet characteristic is also different between the individual nozzles although the difference is minute. Therefore, in the third embodiment, the n types of drive waveform data suitable for the respective nozzles are stored in the memory 24, the first drive waveform signal WCOM1 through the nth drive waveform signal WCOMn corresponding respectively thereto are generated, the first modulated signal MCOM1 through the nth modulated signal MCOMn are output by individually pulse-modulating the drive waveform signals, and the first drive signal COM1 through the nth drive signal COMn corresponding respectively thereto are applied to the actuators 22 of the corresponding nozzles.

Figure 12:
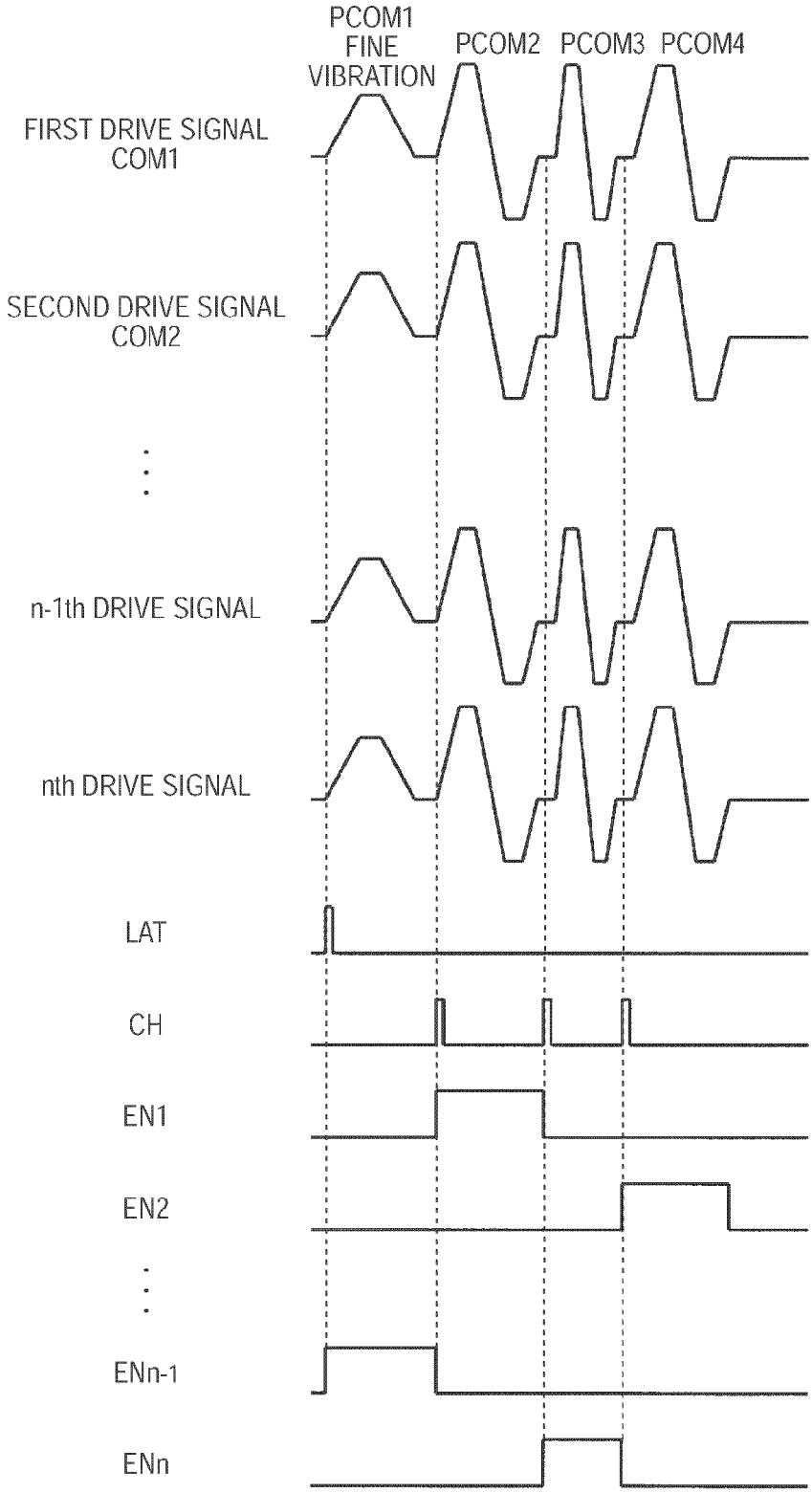
FIG. 12 is a timing chart of the drive signal and the nozzle selection signal by the control circuit and the drive circuit shown in FIG. 11.

FIG. 12 shows an example of the drive signal COM and the nozzle selection signal ENn of the third embodiment. In FIG. 12, the second drive pulse PCOM2 of the first drive signal COM1 is applied to the actuator 22 of the nozzle number 1, the fourth drive pulse PCOM4 of the second drive signal COM2 is applied to the actuator 22 of the nozzle number 2, . . . , the first drive pulse PCOM1 (the fine vibration) of the n−1th drive signal COMn−1 is applied to the actuator 22 of the nozzle number n−1, and the third drive pulse PCOM3 of the nth drive signal COMn is applied to the actuator 22 of the nozzle number n.

As described above, according to the third embodiment, since there is adopted the configuration in which the memory 24 stores the drive waveform data of the respective nozzles, the drive waveform generator 25 generates the drive waveform signals WCOM for the respective nozzles, and the modulator 26 provides the modulated signals MCOM for the respective nozzles by the pulse modulation, by storing the drive waveform data suitable for the liquid jet characteristics of the respective nozzles, the liquid jet characteristics of the respective nozzles can be made constant.

Figure 13:
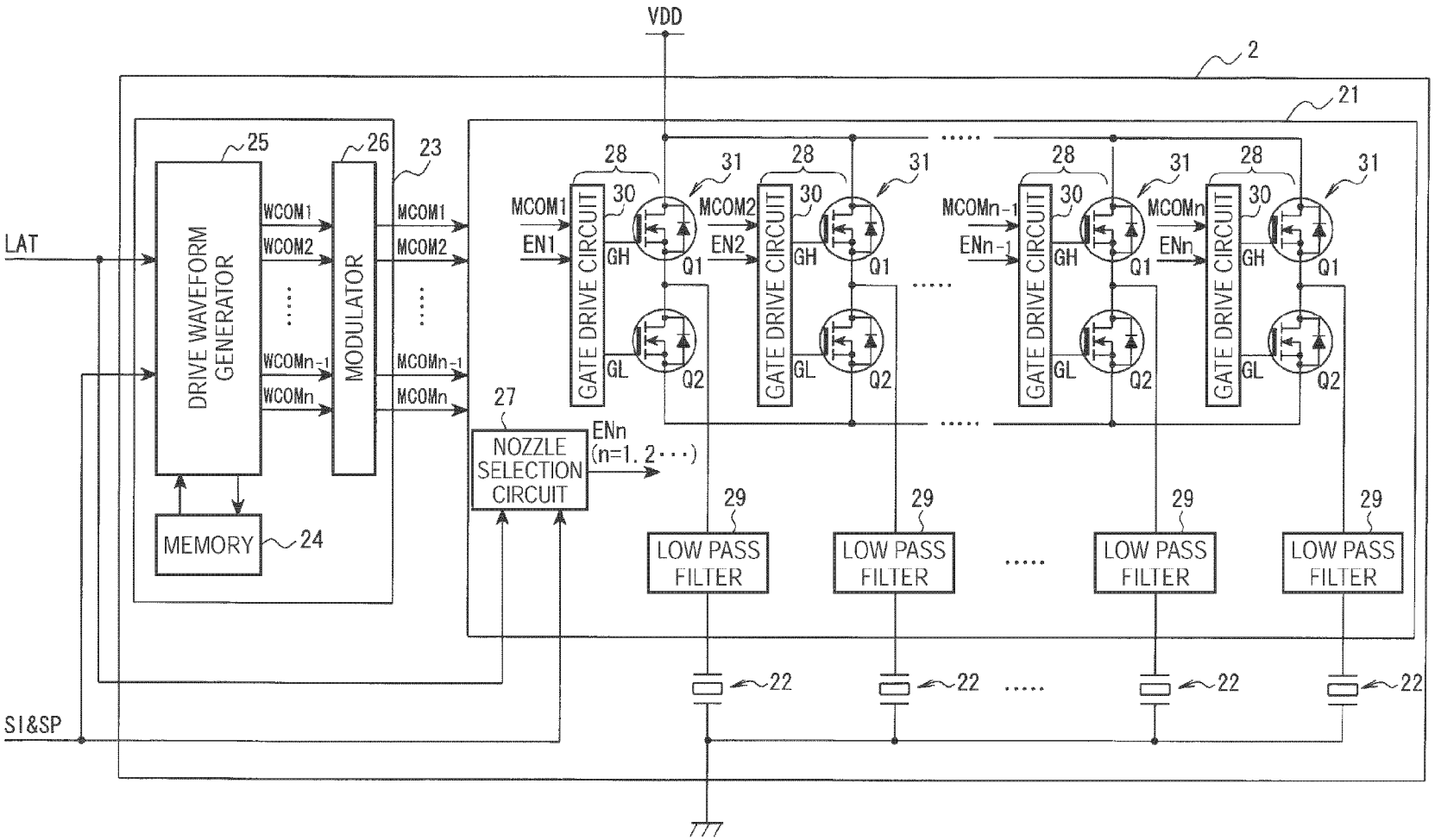
FIG. 13 is a block diagram of the control circuit and the drive circuit provided to the jet head showing a fourth embodiment of the liquid jet apparatus of the invention.

A fourth embodiment of a liquid jet printing apparatus using a liquid jet apparatus will hereinafter be explained. The configuration of the fourth embodiment is almost the same as that of the third embodiment described above, and is slightly different therefrom in the control circuit 23 and the drive circuit 21 disposed in the liquid jet head 2. FIG. 13 shows the configuration of the control circuit 23 and the drive circuit 21 disposed in the liquid jet head 2 of the fourth embodiment. Although the configuration itself of the control circuit 23 and the drive circuit 21 in the liquid jet head 2 of the fourth embodiment is the same as those of the first through third embodiments, the memory 24 stores the drive waveform data corresponding respectively to the number of all of nozzles provided to the liquid jet head 2 similarly to the third embodiment, the drive waveform generator 25 generates a first drive waveform signal WCOM1 through an nth drive waveform signal WCOMn corresponding to those drive waveform data, and the modulator 26 outputs a first modulated signal MCOM1 through an nth modulated signal MCOMn obtained by individually pulse-modulating the drive waveform signals.

Further, the first modulated signal MCOM1 is input to the digital power amplifier 28 of the actuator 22 corresponding to the nozzle number 1, the second modulated signal MCOM2 is input to the digital power amplifier 28 of the actuator 22 corresponding to the nozzle number 2, . . . , the n−1th modulated signal MCOMn−1 is input to the digital power amplifier 28 of the actuator 22 corresponding to the nozzle number n−1, and the nth modulated signal MCOMn is input to the digital power amplifier 28 of the actuator 22 corresponding to the nozzle number n.

Further, the digital power amplifier 28, to which the first modulated signal MCOM1 is input, outputs the first drive signal COM1 via the low pass filter 29, the digital power amplifier 28, to which the second modulated signal MCOM2 is input, outputs the second drive signal COM2 via the low pass filter 29, the digital power amplifier 28, to which the n−1th modulated signal MCOMn−1 is input, outputs the n−1th drive signal COMn−1 via the low pass filter 29, and the digital power amplifier 28, to which the nth modulated signal MCOMn is input, outputs the nth drive signal COMn via the low pass filter 29.

It should be noted that in contrast to the third embodiment in which the first drive pulse PCOM1 through the fourth drive pulse PCOM4 are joined with each other in a time-series manner and output as the drive signal COM, in the fourth embodiment, only the drive pulse PCOM necessary for the corresponding actuator 22 is selected and output as the drive signal COM. The first drive pulse PCOM1 corresponding to the fine vibration is output to the actuator 22, which is not required to emit a liquid jet, as the drive signal COM, or nothing is output thereto. Therefore, in the fourth embodiment, the drive waveform generator 25 reads in the drive pulse selection data SI&SP to select the necessary drive pulse PCOM for the actuator 22, and output it as the drive signal COM. Further, since it is not necessary to sectionalize the plurality of drive pulses PCOM joined with each other in a time-series manner, the latch signal LAT is only used without using the channel signal CH.

Figure 14:
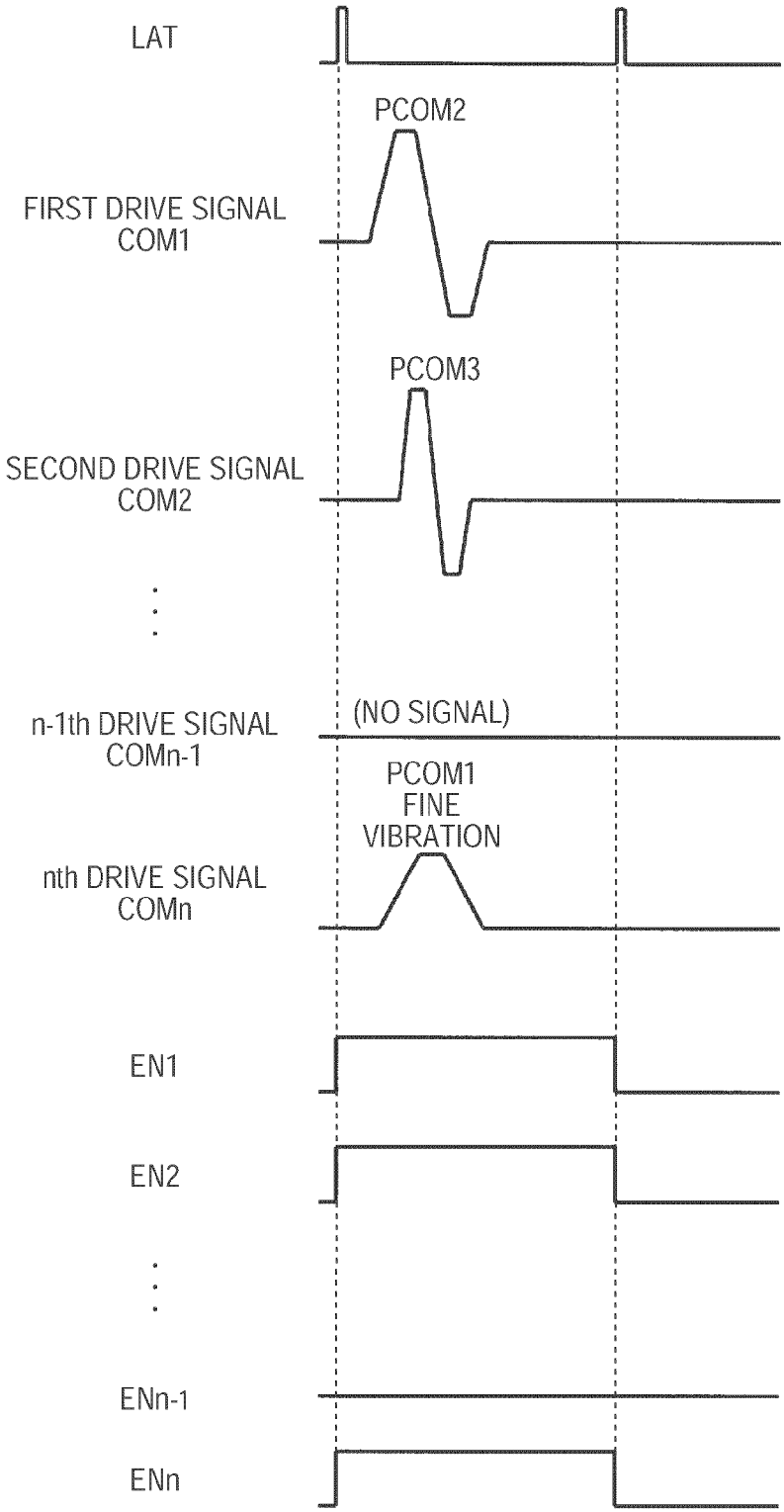
FIG. 14 is a timing chart of the drive signal and the nozzle selection signal by the control circuit and the drive circuit shown in FIG. 13.

FIG. 14 shows an example of the drive signal COM and the nozzle selection signal ENn of the fourth embodiment. In FIG. 14, the second drive pulse PCOM2 of the first drive signal COM1 is applied to the actuator 22 of the nozzle number 1, the third drive pulse PCOM3 of the second drive signal COM2 is applied to the actuator 22 of the nozzle number 2, the n−1th drive signal COMn−1 without a signal is applied to the actuator 22 of the nozzle number n−1, which is not required to emit a liquid jet, and the first drive pulse PCOM1 (the fine vibration) of the nth drive signal COMn is applied to the actuator 22 of the nozzle number n, which is also not required to emit a liquid jet.

As described above, according to the fourth embodiment, by selecting the drive pulse PCOM necessary for the actuator 22 in accordance with the print data, and then applying the drive pulse to the corresponding actuator 22 as the drive signal COM, it is possible to reduce the amount of time required for the drive signal COM, thus reducing the printing time compared to the case of joining the drive pulses PCOM with each other in a time-series manner and outputting it as the drive signal COM.

It should be noted that in the fourth embodiment, there is set the case in which no drive signal is applied to the actuator 22, which is not required to emit a liquid jet. For example, assuming that the state with no signal corresponds to the electric potential of 0, the gate-source signal GH of the high-side switching element Q1 output from the gate drive circuit 30 becomes in the low level, but the gate-source signal GL of the low-side switching element Q2 becomes in the high level, thus the actuator 22 such as a piezoelectric element as a capacitive load is discharged. Therefore, in the fourth embodiment, in the case in which no signal is applied to the actuator 22, which is not required to emit a liquid jet, as is the case with the n−1th nozzle selection signal ENn−1 shown in FIG. 13, the gate-source signals GH, GL output from the gate drive circuit 30 are set to be in the low level by the nozzle selection signal ENn.

However, in the first through fourth embodiments, if an intermediate potential is maintained when the drive signal COM (or the drive pulse PCOM) is absent, the discharge from the actuator 22 such as a piezoelectric element as the capacitive load can be prevented, and therefore, it is possible to apply the drive signal COM (or the drive pulse PCOM) corresponding to the intermediate potential to the actuator 22, which is not required to emit a liquid jet. Further, when arranging things as described above, in the case of applying the necessary drive signals COM (or the drive pulses PCOM) to all of the actuators 22 as is the case for the fourth embodiment, the nozzle selection signal ENn itself becomes unnecessary, and as a result, the nozzle selection circuit 27 becomes also unnecessary, and consequently, the circuit size can be reduced accordingly.

Figure 15:
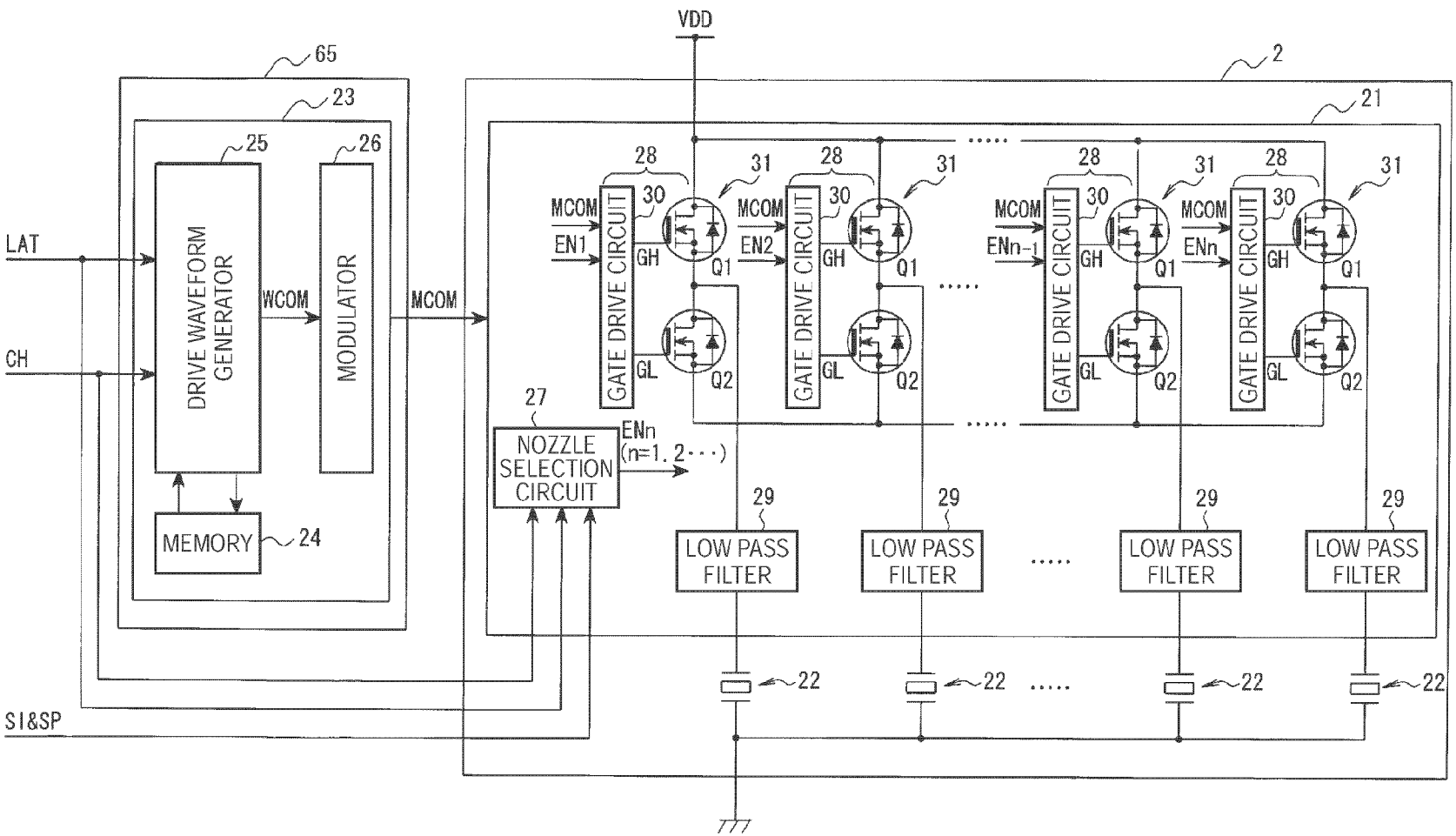
FIG. 15 is a block diagram of the control circuit and the drive circuit showing a fifth embodiment of the liquid jet apparatus of the invention.

A fifth embodiment of a liquid jet printing apparatus using a liquid jet apparatus will hereinafter be explained. The configuration of the fifth embodiment is almost the same as that of the first embodiment described above, and is slightly different therefrom in the control circuit 23 and the drive circuit 21. FIG. 15 shows a configuration of the control circuit 23 and the drive circuit 21 of the fifth embodiment. In the fifth embodiment, although the drive circuit 21 is implemented in the liquid jet head 2 similarly to the first through fourth embodiments, the control circuit 23 is provided to the control apparatus of the main body of the printing apparatus. Specifically, it is disposed in the head driver 65 of the control apparatus shown in FIG. 4 (the interface 67 is omitted).

Since the modulated signal MCOM output from the control circuit 23 is a pulse signal irrespective of which pulse modulation method is used, in the case in which the control circuit 23 in the main body and the drive circuit 21 implemented in the liquid jet head 2 are connected to each other with the FFC, even if the waveform of the modulated signal MCOM is deformed to a certain extent due to the parasitic inductor of the FFC, a modification is hardly caused to the drive signal COM having been power-amplified and smoothed. Therefore, it is not necessarily required for the control circuit 23 for outputting the modulated signal MCOM to be implemented to the liquid jet head 2. For the same reason, it is also possible to provide the control circuit 23 of the second through fourth embodiments to the main body of the printing apparatus. Further, by adopting such a configuration as described above, downsizing of the liquid jet head 2 becomes possible.

It should be noted that although in the first through fifth embodiments described above only the case in which the liquid jet apparatus of the invention is applied to the line head-type printing apparatus is described in detail, the liquid jet apparatus of the invention can also be applied to multi-pass printing apparatuses in a similar manner.

Further, the liquid jet apparatus of the invention can also be embodied as a liquid jet apparatus for emitting a jet of a liquid (including a liquid like member dispersing particles of functional materials, and a fluid such as a gel besides liquids) other than the ink, or a fluid (e.g., a solid substance capable of flowing as a fluid and being emitted as a jet) other than liquids. The liquid jet apparatus can be, for example, a liquid jet apparatus for emitting a jet of a liquid including a material such as an electrode material or a color material used for manufacturing a liquid crystal display, an electroluminescence (EL) display, a plane emission display, or a color filter in a form of a dispersion or a solution, a liquid jet apparatus for emitting a jet of a living organic material used for manufacturing a biochip, or a liquid jet apparatus used as a precision pipette for emitting a jet of a liquid to be a sample.

Further, the liquid jet apparatus can be a liquid jet apparatus for emitting a jet of lubricating oil to a precision machine such as a timepiece or a camera in a pinpoint manner, a liquid jet apparatus for emitting on a substrate a jet of a liquid of transparent resin such as ultraviolet curing resin for forming a fine hemispherical lens (optical lens) used for an optical communication device, a liquid jet apparatus for emitting a jet of an etching liquid of an acid or an alkali for etching a substrate or the like, a fluid jet apparatus for emitting a gel jet, or a fluid jet recording apparatus for emitting a jet of a solid substance including fine particles such as a toner as an example. Further, the invention can be applied to either one of these jet apparatuses.

The entire disclosure of Japanese Patent Application No. 2008-039881 filed on Feb. 21, 2008 is expressly incorporated by reference herein.

What is claimed is:

1. A liquid jet apparatus adapted to emit a jet of a liquid by driving an actuator of a liquid jet head with a drive signal, the liquid jet apparatus comprising:

a digital power amplifier and a low pass filter housed within the liquid jet head so as to correspond to the actuator, and adapted to power-amplify and smooth a modified signal from a control circuit to form the drive signal, wherein the low pass filter is coupled directly with the actuator, and the digital power amplifier is provided with a pair of switching elements and a gate drive circuit, and ON-OFF controls the gate drive circuit based on print data which is input into the digital power amplifier by a nozzle selection circuit, thereby performing one of output and halt of the drive signal.

2. The liquid jet apparatus according to claim 1, wherein the control circuit includes a memory adapted to store drive waveform data of a drive waveform signal forming a basis of a signal for controlling driving of the actuator, a drive waveform generator adapted to generate the drive waveform signal from the drive waveform data, and a modulator adapted to pulse-modulate the drive waveform signal to form a modulated signal, the digital power amplifier power-amplifies the modulated signal to form an amplified digital signal, and the low pass filter smoothes the amplified digital signal to form the drive signal.

3. The liquid jet apparatus according to claim 2, wherein the memory stores drive waveform data of respective nozzle lines, the drive waveform generator generates the drive waveform signals for the respective nozzle lines, and the modulator obtains the modulated signals for the respective nozzle lines by pulse modulation.

4. The liquid jet apparatus according to claim 2, wherein the memory stores drive waveform data of respective nozzles, the drive waveform generator generates the drive waveform signals for the respective nozzles, and the modulator obtains the modulated signals for the respective nozzles by pulse modulation.

5. The liquid jet apparatus according to claim 2, wherein the modulator performs one of pulse width modulation and pulse density modulation.

* * * * *